US007546832B2

(12) United States Patent
Okamoto et al.

(10) Patent No.: US 7,546,832 B2
(45) Date of Patent: Jun. 16, 2009

(54) CONTROL DEVICE OF HIGH-PRESSURE FUEL PUMP OF INTERNAL COMBUSTION ENGINE

(75) Inventors: Takashi Okamoto, Hitachinaka (JP); Hiroyuki Yamada, Hitachinaka (JP); Kousaku Shimada, Hitachinaka (JP); Koji Matsufuji, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 41 days.

(21) Appl. No.: 11/976,977

(22) Filed: Oct. 30, 2007

(65) Prior Publication Data

US 2009/0093942 A1 Apr. 9, 2009

Related U.S. Application Data

(63) Continuation of application No. 10/518,491, filed on Jan. 9, 2006, now Pat. No. 7,299,790.

(51) Int. Cl.
*F02M 37/04* (2006.01)
*F02M 37/06* (2006.01)

(52) U.S. Cl. ..... 123/506

(58) Field of Classification Search ..... 123/501, 123/503, 507, 508, 495, 496, 506, 456, 446
See application file for complete search history.

(56) References Cited

U.S. PATENT DOCUMENTS 6,135,090 A 10/2000 Kawachi et al.
6,343,588 B1 2/2002 Onishi et al.
6,526,947 B2 3/2003 Shimada et al.
2001/0006061 A1 7/2001 Shimada et al.
2005/0126539 A1 6/2005 Okamoto

FOREIGN PATENT DOCUMENTS

| | | |
|---|---|---|
| EP | 1 281 860 | 2/2003 |
| EP | 1 327 766 | 7/2003 |
| JP | 63-117147 | 5/1988 |
| JP | 8-303325 | 11/1996 |
| JP | 10-288105 | 10/1998 |
| JP | 2002-188545 | 7/2002 |

*Primary Examiner*—Mahmoud Gimie
(74) *Attorney, Agent, or Firm*—Mattingly & Malur, PC

(57) ABSTRACT

A control device of a high-pressure fuel pump of an internal combustion engine capable of improving stability in controlling the drive of the high-pressure fuel pump by limiting the end timing of a drive signal of the high-pressure fuel pump and driving an actuator in a control effective range of the high-pressure fuel pump. The control device of the high-pressure fuel pump of the internal combustion engine has a fuel injection valve provided on a cylinder and the high-pressure fuel pump for pumping fuel to the fuel injection valve, wherein the high-pressure fuel pump comprises a pressure chamber, a plunger for pressurizing the fuel in the pressure chamber, a fuel valve provided in the pressure chamber, and the actuator for operating the fuel valve. The control device has means for calculating the drive signal of the actuator so as to realize the variable discharge of the high-pressure fuel pump. The means for calculating the drive signal has means for limiting the end timing of the drive signal of the actuator to a predetermined phase and/or means for limiting the output timing of the drive signal of the actuator to be within a predetermined phase range.

20 Claims, 28 Drawing Sheets

CONTROL DEVICE OF HIGH-PRESSURE FUEL PUMP OF INTERNAL COMBUSTION ENGINE

The above-referenced patent application is a continuation application of U.S. Ser. No. 10/518,491, filed Jan. 9, 2006 now U.S. Pat. No. 7,299,790, which is hereby incorporated by reference into this application.

TECHNICAL FIELD

The present invention relates to a control device of a high-pressure fuel pump of an internal combustion engine, and more particularly to a control device of a high-pressure fuel pump of an internal combustion engine capable of realizing the variable discharge of high-pressure fuel to be pumped to a fuel injection valve of the internal combustion engine.

BACKGROUND ART

The present automobiles have been required to reduce emission gas of specific substances such as carbon monoxide (CO), carbon hydride (HC) and oxide nitrogen (NOx) which are contained in emission gas from automobiles from a point of view of environmental preservation, and with the objective of these reduction, a direct injection engine (direct injection internal combustion engine) has been developed. In the direct injection internal combustion engine, fuel injection using a fuel injection valve is directly performed within a combustion chamber of a cylinder, and a particle size of fuel to be injected from the fuel injection valve is made small, whereby combustion of the injection fuel is promoted to reduce the specific substances in the emission gas and to improve output of the internal combustion engine among others.

In order to make the particle size of fuel to be injected from the fuel injection valve small, the need for means for pressurizing the fuel to high pressure arises, and for this reason, there have been proposed various techniques of a high-pressure fuel pump for pumping high-pressure fuel to the fuel injection valve (See, for example, Japanese Patent Laid-Open Nos. 10-153157, 2001-123913, 2000-8997, 11-336638, 11-324860, 11-324757, 2000-18130, and 2001-248515).

The technique described in the Japanese Patent Laid-Open No. 10-153157 improves fuel supply capacity in a high-pressure fuel supply device of the internal combustion engine, and in a variable discharge high-pressure pump of the device, to the pump chamber, there are communicated three passages, that is: a flow-in passage for flowing low-pressure fuel into the pump chamber; a supply passage for feeding high-pressure fuel to a common rail, and a spill passage. To the spill passage, there is connected a spill valve, and by an open-close operation of the spill valve, a spill amount to a fuel tank is controlled to thereby adjust the discharge. The technique of Japanese Patent Laid-Open No. 2001-123913 is to adjust the discharge by changing capacity of the pump chamber during a period from start of an intake stroke to immediately before end of a discharge stroke.

Also, the technique described in the Japanese Patent Laid-Open No. 2000-8997 controls a flow rate of high-pressure fuel to be supplied in response to injection quantity of the fuel injection valve, whereby even when a driving force of the high-pressure fuel pump lowers and a flow rate controlling valve does not operate, the technique supplies the fuel. When pressure on the downstream side (pressure chamber side) of the inlet valve is equal to or higher than pressure on the upstream side (inlet port side), a valve closing force occurs on the inlet valve, and there are provided an engaging member to which a biasing force has been given so as to engage when the inlet valve moves in a valve closing direction, and an actuator which exerts a biasing force in a direction opposite to the biasing force on the engaging member due to external input, and an open-close operation of the inlet valve adjusts the fuel discharge.

Further, the technique described in the Japanese Patent Laid-Open No. 11-336638 performs fuel metering accurately irrespective of the operating state of the internal combustion engine, and in a three-cylinder type pump, in order to prevent cycle variations in the fuel discharge, opening and closing of an electromagnetic valve is controlled in synchronization with feeding by the pump under pressure.

Further, also the technique described in the Japanese Patent Laid-Open No. 11-324860 enhances, in the variable discharge high-pressure pump, accuracy in flow rate control, miniaturizes the device, and reduces the cost. The technique described in the Japanese Patent Laid-Open No. 11-324757 improves, in a device for variable-controlling fuel injection pressure, response when target pressure changes, and the technique described in the Japanese Patent Laid-Open No. 2000-18130 relieves the fuel to be discharged from the fuel pump on the suction side through the use of an always-closed electromagnetic valve to control fuel pressure on the fuel injection valve side for improving the reliability.

Further, in the technique described in the Japanese Patent Laid-Open No. 2001-248515, a valve opening signal to be given to the always-closed electromagnetic valve is constructed so as to be completed at a predetermined position past a top dead center in the intake stroke from the top dead center of a fuel pump plunger toward a bottom dead center in order to prevent an abnormal rise in the coil temperature.

In a conventional operating timing chart for fuel pressure control by the variable discharge high-pressure pump, a REF signal 1801 is generated from a cam angle signal and a crank angle signal as shown in FIG. 27, and with the REF signal 1801 as a reference, a solenoid control signal (pulse) 1802 that is an actuator drive signal is outputted by angle or time control. Since a current flows through the coil for a while even if the solenoid control signal 1802 is terminated, the solenoid remains the attracting force as it is.

When, for example, the pump is required to discharge a small amount, the solenoid control signal 1802 is outputted (detail of control contents will be described later) in the vicinity of the plunger top dead center as shown in FIG. 27, and when the attraction force of the solenoid remains maintained up to the next discharge stroke at this time, the pump discharges the whole amount due to the characteristic of the high-pressure fuel pump. In other words, since the pump is required to discharge a small amount while the high-pressure pump discharges the whole amount, it becomes possible that measured fuel pressure follows the target fuel pressure.

Also, when the target fuel pressure 1803 calculated on the basis of the number of revolutions and load rises significantly as shown in FIG. 28, in order to cause measured fuel pressure 1804, that is actual fuel pressure, to follow the target fuel pressure 1803, as much fuel as possible is going to be discharged and F/B amount becomes larger, and therefore, the solenoid control signal 1802 is outputted in a domain, which is not an original domain to be discharged. If this output is continued, the solenoid control signal 1802 will be able to be outputted from the REF signal 1801, that is a reference point, as shown in FIG. 28.

In this case, for example, when the REF signal 1801 is not on a phase capable of pumping the fuel in the discharge passage, the high-pressure pump becomes unable to pump the fuel in the discharge passage, and on the other hand, the fuel injection valve injects the fuel, and therefore, the measured fuel pressure 1804 will become unable to follow the target fuel pressure 1803.

As understood from these examples, the conventional one will become unable to realize the optimum fuel pressure in an operating condition of the internal combustion engine, stable combustion will not be obtained because of fuel adherence to the surface of a piston or the like, resulting in a problem of worsened emission gas.

In other words, the present inventor has obtained knowledge that in control of the variable discharge high-pressure pump, timing of outputting the solenoid control signal, timing of terminating and control of its width are important. That is, the present inventor has obtained new knowledge that the high-pressure fuel pump control device calculates end timing of a drive signal of the actuator through the use of at least one of the number of revolutions of the engine, the injection quantity from the fuel injection valve, battery voltage, and coil resistance, limits to be prior to the top dead center of the plunger, and output timing of a drive signal of the actuator must be limited to be within a predetermined actuator operating time period that is a phase range capable of pumping, and within a time period until the plunger reaches the top dead center from the bottom dead center.

As regards each of the above-described conventional techniques, however, for example, transmitting open-close timing of a spill valve for adjusting an amount of fuel to be pumped to the common rail from the control device, and the like have been described, but concerning an item of restricting a control signal of the solenoid, which is an actuator of the variable discharge high-pressure pump, no description has been made, nor any special attention has been given to the above-described item.

The present invention has been achieved in view of such problems as described above, and is aimed to provide a control device of a high-pressure fuel pump of an internal combustion engine capable of improving stability in controlling the drive of the high-pressure fuel pump by limiting the end timing of a drive signal of the high-pressure fuel pump and driving an actuator in a control effective range of the high-pressure fuel pump.

DISCLOSURE OF THE INVENTION

In order to achieve the above-described object, a control device of a high-pressure fuel pump of an internal combustion engine according to the present invention has basically a fuel injection valve provided on a cylinder and the high-pressure fuel pump for pumping fuel to the fuel injection valve, characterized in that the high-pressure fuel pump comprises a pressure chamber, a plunger for pressurizing the fuel in the pressure chamber, a fuel valve provided in the pressure chamber, and the actuator for operating the fuel valve, and that the control device has means for calculating the drive signal of the actuator so as to realize the variable discharge or pressure of the high-pressure fuel pump, and that the means for calculating the drive signal has means for limiting the end timing of the drive signal of the actuator to a predetermined phase.

The control device of a high-pressure fuel pump of an internal combustion engine according to the present invention constructed as described above is capable of controlling fuel pressure optimally and swiftly and contributing to stabilization of combustion and improvement of emission gas performance because output timing of the drive signal from the actuator for causing an inlet passage of the fuel to be closed has been limited to be within a phase range for reliably enabling the fuel discharge to be controlled.

Also, a specific aspect of the control device of a high-pressure fuel pump of an internal combustion engine according to the present invention is characterized in that the means for limiting to the predetermined phase limits the end timing of a drive signal of the actuator to be prior to the top dead center of the plunger.

Further, another specific aspect of the control device of a high-pressure fuel pump of an internal combustion engine according to the present invention is characterized in that the means for limiting to the predetermined phase calculates the end timing of a drive signal of the actuator through the use of at least one of a number of revolutions of the engine, injection quantity from the fuel injection valve, battery voltage and coil resistance.

Further, a specific aspect of the control device of a high-pressure fuel pump of an internal combustion engine according to the present invention is characterized in that means for limiting to the predetermined phase uses an electronic circuit, and is characterized in that when the end timing of a drive signal of the actuator is limited to the predetermined phase, at least one of injection quantity from the fuel injection valve, fuel injection timing, and ignition timing is changed and controlled.

The control device of a high-pressure fuel pump of an internal combustion engine according to the present invention constructed as described above is, in addition to the end timing of a drive signal of the actuator having been limited to the predetermined phase, capable of switching combustion of the internal combustion engine for control on the basis of whether or not the operation of the internal combustion engine is under stratified charge combustion, whether or not pulsation of the fuel pressure is within an allowable value, and the like.

Another aspect of the control device of a high-pressure fuel pump of an internal combustion engine according to the present invention is characterized in that the control device has means for calculating a drive signal of the actuator so as to realize the variable discharge or pressure of the high-pressure fuel pump; that the means for calculating the drive signal has means for not outputting any drive signal when output timing of a drive signal of the actuator is the predetermined phase and thereafter; and that when the drive signal has not been outputted, at least one of injection quantity from the fuel injection valve, fuel injection timing, and ignition timing is changed and controlled.

In the control device of a high-pressure fuel pump of an internal combustion engine according to the present invention constructed as described above, in control processing of the pump control device, requested time period for driving the actuator may exceed driving time to be calculated under operating conditions and the like, and in such a case, there is a possibility that the fuel valve reliably cannot be closed as the worst condition, and there is a possibility that the high-pressure pump cannot pump, but the fuel pressure makes the pulsation great. In this case, it is judged impossible to output a drive signal of the actuator, and as pump phase control signal driving time=0, energization to the solenoid (driving of the actuator) is forbidden.

Further, another aspect of the control device of a high-pressure fuel pump of an internal combustion engine according to the present invention is characterized in that the control device has means for calculating a drive signal of the actuator so as to realize the variable discharge of the high-pressure fuel pump; and that the means for calculating the drive signal has means for limiting the output timing of a drive signal of the actuator to be within a predetermined phase range.

In the control device of a high-pressure fuel pump of an internal combustion engine according to the present invention constructed as described above, since after a restricted interval with a REF signal as a reference, a drive signal of the actuator can be outputted at an angle or in a time period within a phase range capable of pumping the fuel, even if the target fuel pressure is raised high, it is possible to secure the fuel discharge at the bottom dead center of the plunger; the measured fuel pressure, that is actual fuel pressure, is followed swiftly by the target fuel pressure to promote a rise in fuel pressure; atomization of a spray particle size from each fuel injection valve can be promoted; it is also possible to achieve reduction in discharge amount of HC; and at the time of starting the internal combustion engine, the starting time period can be shortened.

Further, another specific aspect of the control device of a high-pressure fuel pump of an internal combustion engine according to the present invention is characterized in that means for limiting to be within the predetermined phase range limits output timing of a drive signal of the actuator to be a point of time whereat we went back to the past from the bottom dead center of the plunger by a time period corresponding to the actuator operating time period, and thereafter; that output timing of a drive signal of the actuator is limited to be within a point of time whereat the plunger arrives at the top dead center, and further that the output timing of a drive signal of the actuator is limited to be while the plunger arrives at the top dead center from the bottom dead center, and prior to the bottom dead center of the plunger and within an operating time period of the actuator.

Further, another specific aspect of the control device of a high-pressure fuel pump of an internal combustion engine according to the present invention is characterized in that the means for calculating a drive signal of the actuator has means for operating a reference angle of the actuator on the basis of a basic angle of the actuator, target fuel pressure and actual fuel pressure, and means for correcting an working delay of the actuator, and calculates operation starting time of the actuator on the basis of these output signals; that means for limiting to be within the predetermined phase range limits an output signal from means for operating the reference angle of the actuator; and further that the means for limiting within a range of the predetermined phase limits output signals from means for operating a reference angle of the actuator and means for correcting working delay of the actuator.

Further, another specific aspect of the control device of a high-pressure fuel pump of an internal combustion engine according to the present invention is characterized in that the means for limiting to be within the predetermined phase range retrieves the phase range in response to an operating state of the internal combustion engine; that the means for limiting to be within the predetermined phase range limits an amount of feedback control to be calculated from a difference between the actual fuel pressure and the target fuel pressure; the means for limiting to be within the predetermined phase range limits an amount of control for causing the actual fuel pressure to coincide with the target fuel pressure; and that the means for limiting to be within the predetermined phase range is an electronic circuit.

Further, another specific aspect of the control device of a high-pressure fuel pump of an internal combustion engine according to the present invention is characterized in that means for calculating a drive signal of the actuator makes the width of a drive signal of the actuator variable by the number of revolutions of the internal combustion engine or/and the battery voltage.

Further, another aspect of the control device of a high-pressure fuel pump of an internal combustion engine according to the present invention is characterized in that when the control device compares the actual fuel pressure with the target fuel pressure, the pressure difference exceeds a predetermined value, and continues for a predetermined time period or longer, the control device prohibits the high-pressure fuel pump from pressurizing; when the control device compares the actual fuel pressure with the target fuel pressure, the pressure difference exceeds a predetermined value and the actual fuel pressure is lower than the target fuel pressure, the control device causes the high-pressure fuel pump to discharge the whole; when the control device compares the actual fuel pressure with the target fuel pressure, the pressure difference exceeds a predetermined value and the actual fuel pressure is higher than the target fuel pressure, the control device prohibits the high-pressure fuel pump from pressurizing; and the predetermined value or the predetermined time period is retrieved in response to an operating state of the internal combustion engine.

In the control device of a high-pressure fuel pump of an internal combustion engine according to the present invention constructed as described above, when a pressure difference between the target fuel pressure and the measured fuel pressure is under a fixed value, ordinary F/B control is performed so as to cause the measured fuel pressure to follow the target fuel pressure; and when the target fuel pressure is higher than the measured fuel pressure, entire discharge control from the bottom dead center of the plunger can be performed. In other words, the high-pressure fuel pump is caused to perform the entire discharge, whereby the measured fuel pressure can be brought close to the target fuel pressure swiftly.

On the other hand, when the measured fuel pressure is higher than the target fuel pressure, pressurizing-forbidden control by the high-pressure fuel pump will be performed. In other words, an OFF signal of the actuator is outputted or an ON signal is outputted at the top dead center of the plunger and pressurizing by the high-pressure fuel pump is forbidden, whereby the measured fuel pressure can be brought close to the target fuel pressure swiftly.

Also, when an abnormal condition is encountered in the high-pressure fuel piping system and the fuel pressure rises higher than the fixed value, this is capable of contributing to the improved safety of the system because the high-pressure fuel pump is prohibited from pressurizing and the fuel pressure can be restrained from rising.

BEST MODE FOR CARRYING OUT THE INVENTION

Hereinafter, with reference to the drawings, the description will be made of a control device of a high-pressure fuel pump of an internal combustion engine according to an embodiment of the present invention.

Figure 1:
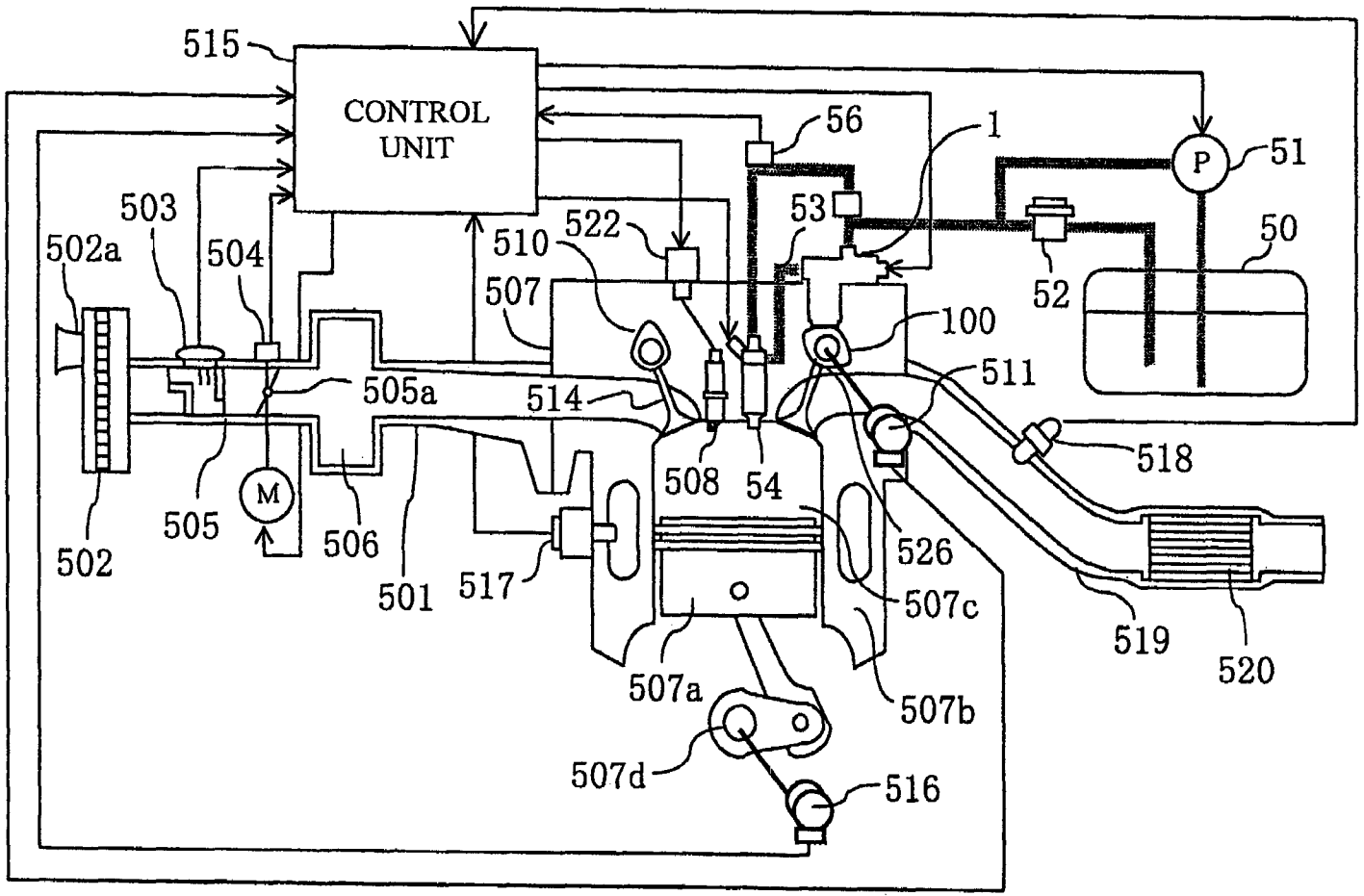
FIG. 1 is a general block diagram showing a control system of an internal combustion engine equipped with a control device of a high-pressure fuel pump according to an embodiment of the present invention.

FIG. 1 shows the general construction of a control device of a direct injection internal combustion engine 507 equipped with a control device of a high-pressure fuel pump according to the present embodiment. The direct injection internal combustion engine 507 consists of four cylinders, and air to be introduced to each cylinder 507*b* is taken in from an inlet portion 502*a* of an air cleaner 502, passes through an air flow sensor 503, and enters a collector 506 through a throttle body 505 in which an electric control throttle valve 505*a* for controlling an intake air flow rate has been accommodated. The air that has been sucked into the collector 506 is distributed to each intake pipe 501 connected to each cylinder 507*b* of the internal combustion engine 507, and thereafter is introduced into a combustion chamber 507*c* which is formed by a piston 507*a*, the cylinder 507*b* and the like via an inlet valve 514 to be driven by a cam 510.

Also, from the air flow sensor 503, a signal showing the intake air flow rate is outputted to a control unit 515 of an internal combustion engine having a control device of a high-pressure fuel pump according to the present embodiment. Further, to the throttle body 505, there is installed a throttle sensor 504 for detecting an opening of the electric control throttle valve 505*a*, and its signal is also to be outputted to the control unit 515.

On the other hand, fuel such as gasoline is primarily pressurized from a fuel tank 50 by a fuel pump 51; is pressure-adjusted to fixed pressure (for example, 3 kg/cm$^2$) by a fuel pressure regulator 52; is secondarily pressurized to higher pressure (for example, 50 kg/cm$^2$) by a high-pressure fuel pump 1 to be described later; and is injected into a combustion chamber 507*c* from a fuel injection valve 54 provided on each cylinder 507*b* via a common rail 53. The fuel injected into the combustion chamber 507*c* is ignited by an ignition plug 508 through an ignition signal raised to high voltage by an ignition coil 522.

A crank angle sensor 516 attached to a crankshaft 507*d* of the internal combustion engine 507 outputs a signal indicating a position of rotation of the crankshaft 507*d* to the control unit 515; and a cam angle sensor 511 attached to a camshaft (not shown) of an exhaust valve 526 outputs an angle signal indicating a position of rotation of the camshaft to the control unit 515, and outputs also an angle signal indicating a position of rotation of a pump driving cam 100 of the high-pressure fuel pump 1 to the control unit 515.

Further, an A/F sensor 518 provided upstream of a catalyst 520 in an exhaust pipe 519 detects emission gas, and its detection signal is also outputted to the control unit 515.

Figure 2:
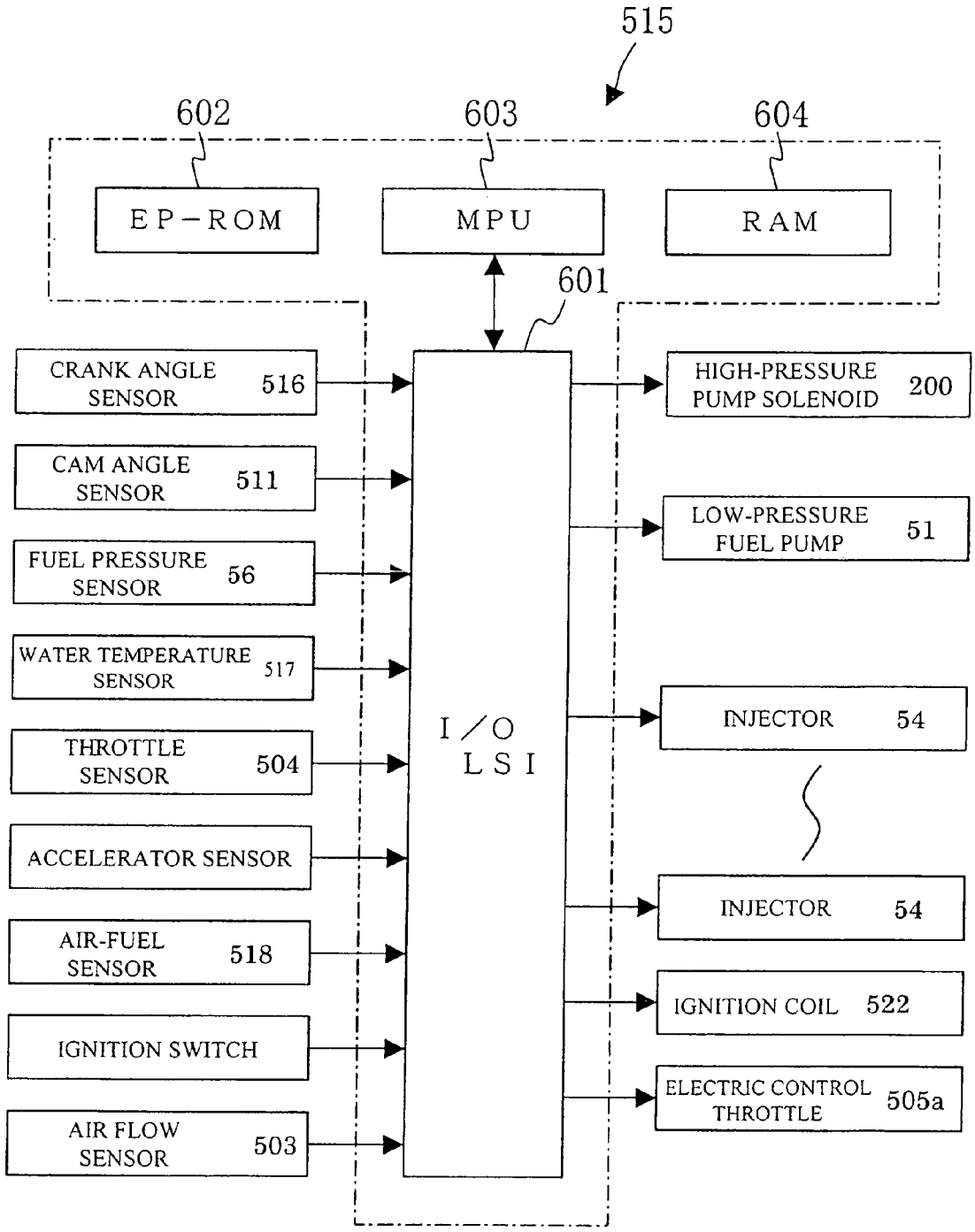
FIG. 2 is an internal block diagram showing the control device of an internal combustion engine of FIG. 1.

As shown in FIG. 2, a principal part of the control unit 515 is constructed of an I/O LSI601 and the like, including MPU603, EP-ROM602, RAM604 and A/D converter, takes in, as input, signals from various sensors and the like, including the crank angle sensor 516, the cam angle sensor 511, an internal combustion engine cooling water temperature sensor 517, and the fuel pressure sensor 56, executes predetermined arithmetic processing, outputs various control signals calculated as this arithmetic result, outputs predetermined control signals to a high-pressure pump solenoid 200, which is an actuator, each of the fuel injection valves 54 and the ignition coils 522 and the like to execute fuel discharge control, injection quantity control, ignition timing control, and the like.

Figure 3:
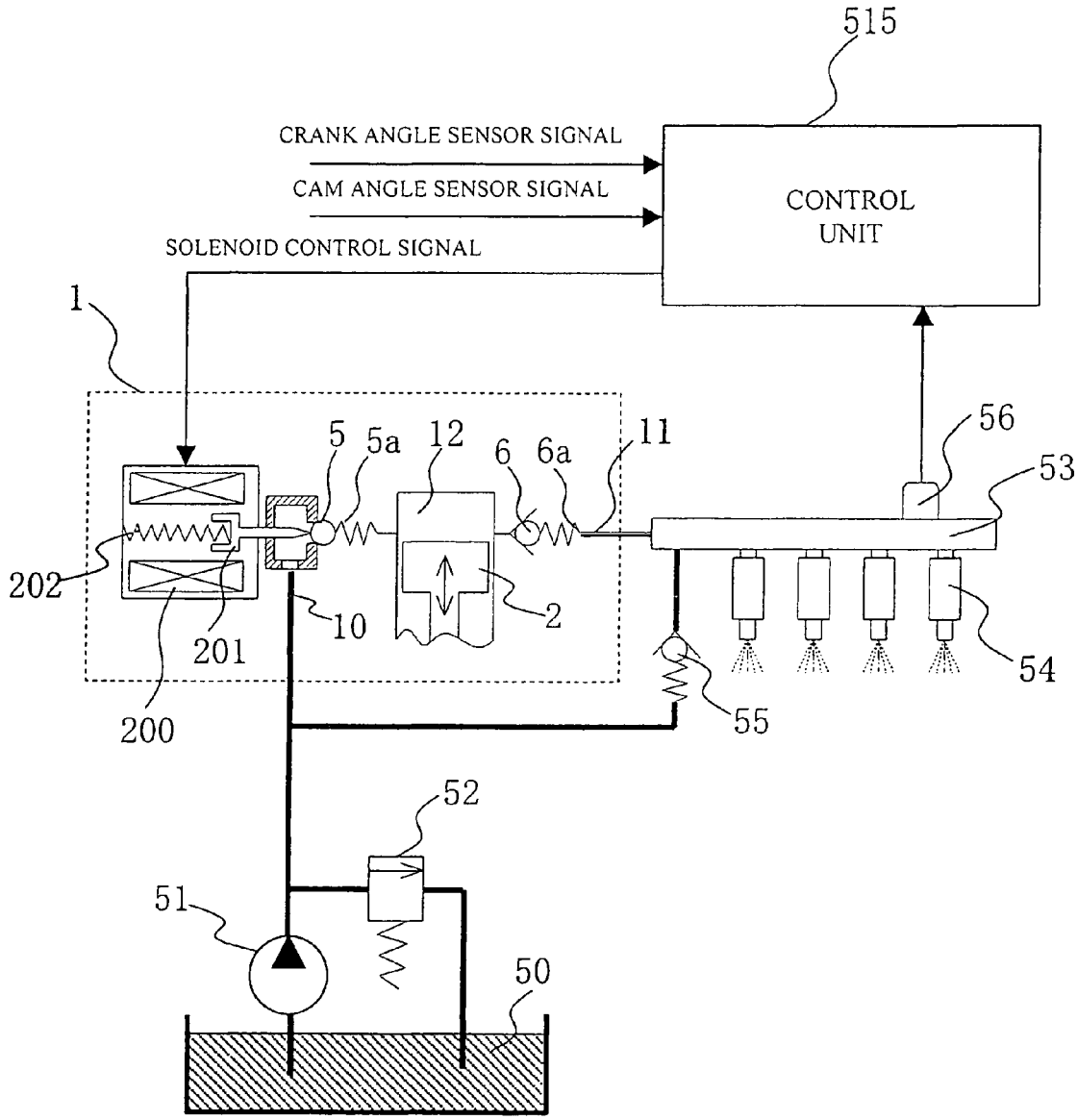
FIG. 3 is a general block diagram showing a fuel system equipped with the high-pressure fuel pump of FIG. 1.
Figure 4:
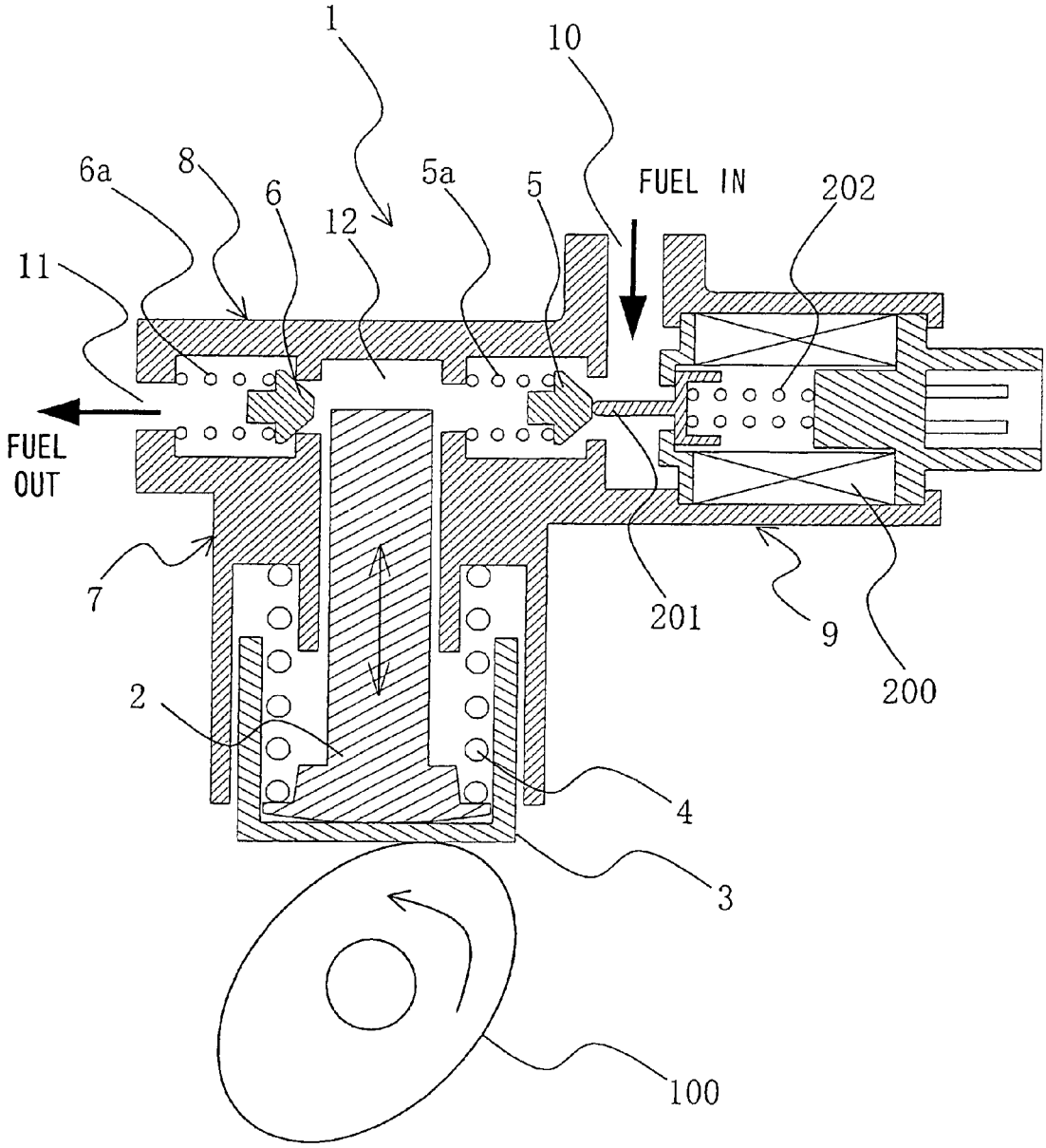
FIG. 4 is a longitudinal section showing the high-pressure fuel pump of FIG. 3.

FIGS. 3 and 4 show the high-pressure fuel pump 1, and FIG. 3 is a general block diagram showing a fuel system equipped with the high-pressure fuel pump 1, and FIG. 4 is a longitudinal section showing the high-pressure fuel pump 1.

The high-pressure fuel pump 1 is used to pump fuel at high pressure to the common rail 53 by pressurizing the fuel from the fuel tank 50, and is composed of a cylinder chamber 7, a pump chamber 8 and a solenoid chamber 9. The cylinder chamber 7 is arranged below the pump chamber 8, and the solenoid chamber 9 is arranged on the intake side of the pump chamber 8.

The cylinder chamber 7 has a plunger 2, a lifter 3 and a plunger descending spring 4, and the plunger 2 reciprocates via a lifter 3 which has been held in press contact with a pump driving cam 100 which rotates as the camshaft of the exhaust valve 526 in the internal combustion engine 507 rotates to change the capacity of the pressure chamber 12.

The pump chamber 8 is composed of an inlet passage 10 for low-pressure fuel, a pressure chamber 12, and a discharge passage 11 for high-pressure fuel; between the inlet passage 10 and the pressure chamber 12, there is provided an inlet valve 5. The inlet valve 5 is a check valve for limiting a direction of circulation of fuel via a valve closing spring 5*a* for biasing from the pump chamber 8 toward the solenoid chamber 9 in the valve closing direction of the inlet valve 5. Between the pressure chamber 12 and a discharge passage 11, there is provided a discharge valve 6, and the discharge valve 6 is also a check valve for limiting a direction of circulation of fuel via a valve closing spring 6*a* for biasing from the pump chamber 8 toward the solenoid chamber 9 in a valve closing direction of the discharge valve 6. In this respect, the valve closing spring 5*a* biases so as to close the inlet valve 5 when pressure on the pressure chamber 12 side becomes equal to or higher than pressure on the flow-in passage 10 side with the inlet valve 5 interposed therebetween due to a change in capacity within the pressure chamber 12 by the plunger 2.

The solenoid chamber 9 is composed of a solenoid 200, which is an actuator, an inlet valve engaging member 201 and a valve opening spring 202. The inlet valve engaging member 201 has its tip which abuts upon the inlet valve 5 in such a manner as to be freely movable toward and away from, is disposed in a position opposite to the inlet valve 5, and moves in a direction to close the inlet valve 5 by the energizing of the solenoid 200. On the other hand, in a state in which the solenoid 200 has been de-energized, the inlet valve engaging member 201 moves in a direction that opens the inlet valve 5 via a valve opening spring 202 engaging with its rear end to bring about an opened valve state to the inlet valve 5.

The fuel that has been pressure-adjusted to fixed pressure from the fuel tank 50 via the fuel pump 51 and a fuel pressure regulator 52 is introduced to the inlet passage 10 of the pump chamber 8, is, thereafter, pressurized by reciprocation of the plunger 2 in the pressure chamber 12 within the pump chamber 8, and is fed under pressure from the discharge passage 11 of the pump chamber 8 to the common rail 59.

The common rail 53 is, in addition to each fuel injection valve 54 provided in accordance with a number of cylinders of the internal combustion engine 507, provided with a relief valve 55 and a fuel pressure sensor 56. The control unit 515 outputs a drive signal of the solenoid 200 on the basis of each detection signal of the crank angle sensor 516, the cam angle sensor 511 and the fuel pressure sensor 56 to control the fuel discharge of the high-pressure fuel pump, and outputs drive signals of each fuel injection valve 54 to control fuel injection. In this respect, the relief valve 55 is opened when the pressure within the common rail 53 exceeds a predetermined value to prevent the piping system from being damaged.

Figure 5:
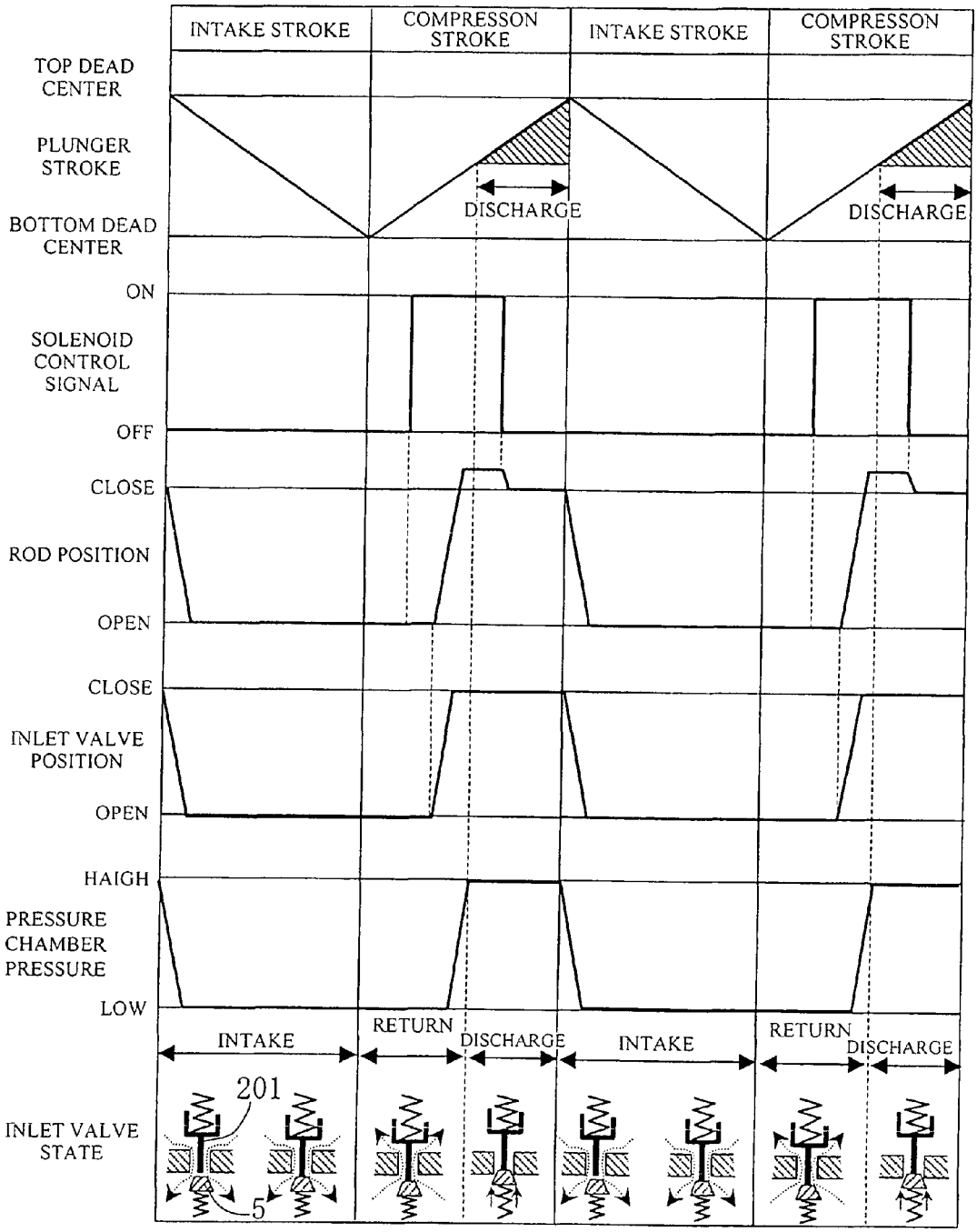
FIG. 5 is an operation timing chart of the high-pressure fuel pump of FIG. 3.
Figure 6:
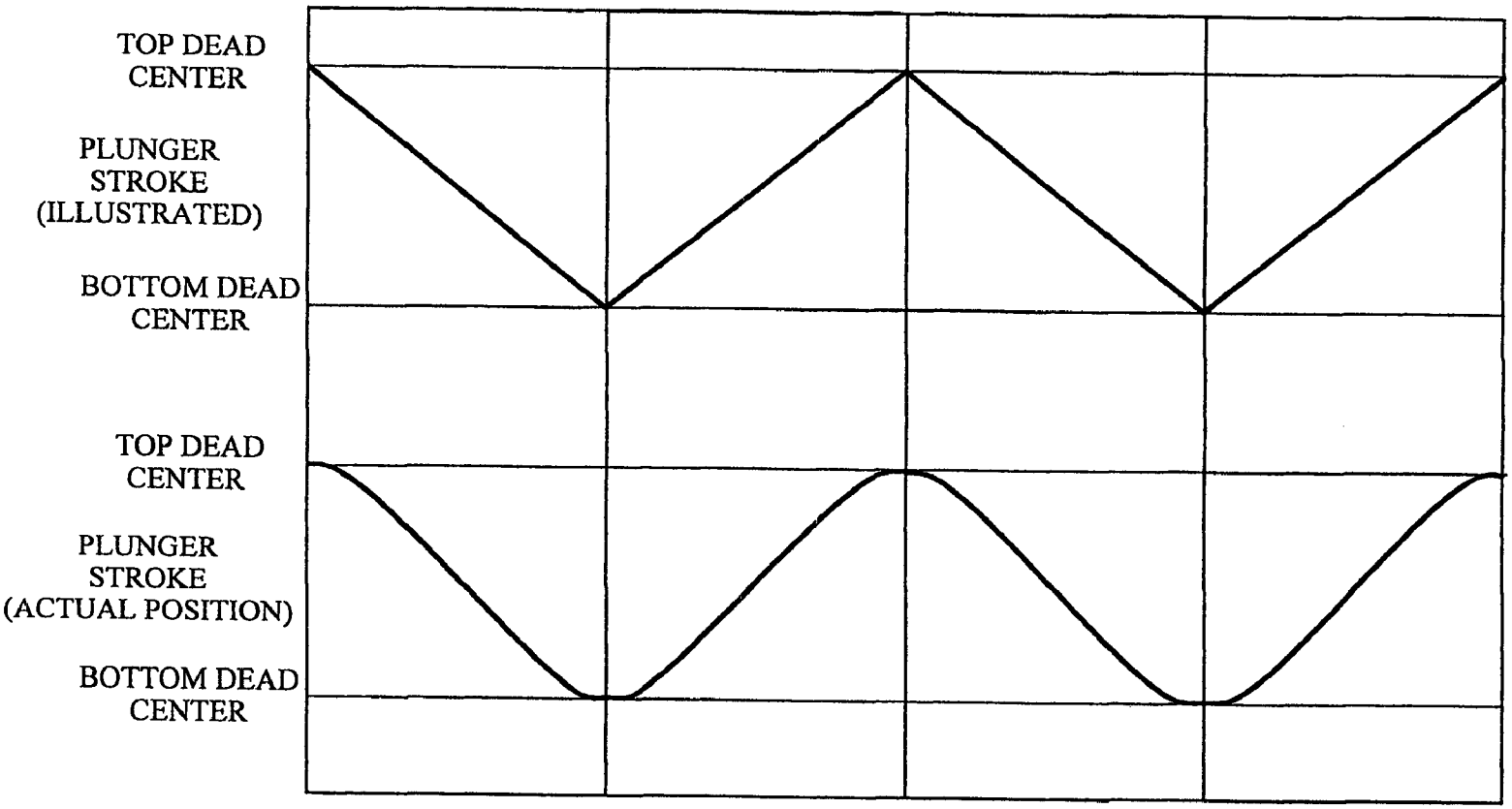
FIG. 6 is an auxiliary explanatory view for the operation timing chart of FIG. 5.

FIG. 5 shows an operation timing chart of the high-pressure fuel pump 1. In this respect, an actual stroke (actual position) of the plunger 2 to be driven by a pump driving cam 100 becomes such a curve as shown in FIG. 6, but in order to make positions of the top dead center and the bottom dead center easier to understand, strokes of the plunger 2 will be represented linearly hereinafter.

Next, on the basis of the structure of FIG. 4 and the operation timing chart of FIG. 5, the description will be made of a specific operation of the high-pressure fuel pump 1.

When the plunger 2 moves from the top dead center side to the bottom dead center in response to a biasing force of the plunger descending spring 4 due to the rotation of the cam 100, an intake stroke of the pump chamber 8 is performed. In the intake stroke, a position of the rod, which is the inlet valve engaging member 201, engages with the inlet valve 5 in response to the biasing force of a valve opening spring 202 to move the inlet valve 5 in a valve opening direction and the pressure within the pressure chamber 12 drops.

Next, when the plunger 2 moves from the bottom dead center side to the top dead center side against the biasing force of the plunger descending spring 4 due to the rotation of the cam 100, a compression stroke in the pump chamber 8 is performed. In the compression stroke, when a drive signal (ON signal) of the solenoid 200, which is an actuator, is outputted from the control unit 515 and the solenoid 200 is energized (ON state), the position of the rod, which is the inlet valve engaging member 201, moves the inlet valve 5 in a valve closing direction against the biasing force of the valve opening spring 202, and its tip is released from the engagement with the inlet valve 5; and the inlet valve 5 moves in the valve closing direction in response to the biasing force of the valve closing spring 5*a*, whereby the pressure within the pressure chamber 12 rises.

Thus, when the inlet valve engaging member 201 is attracted on the solenoid 200 side extremely, the inlet valve 5 which synchronizes to the reciprocation of the plunger 2 closes the valve and the pressure within the pressure chamber 12 rises, the fuel within the pressure chamber 12 presses the discharge valve 6 and the discharge valve 6 automatically opens the valve against the biasing force of the valve closing spring 6*a*, and high-pressure fuel of an amount corresponding to the reduction in the capacity of the pressure chamber 12 is discharged on the common rail 53 side. In this respect, when the inlet valve 5 is closed on the solenoid 200 side, the energizing of the drive signal of the solenoid 200 is stopped (OFF state), but since the pressure within the pressure chamber 12 is high as described above, the inlet valve 5 is maintained at the valve closed state, and the fuel is discharged on the common rail 53 side.

Also, when the plunger 2 moves from the top dead center side to the bottom dead center side in response to the biasing force of the plunger descending spring 4 due to the rotation of the cam 100, a suction stroke in the pump chamber 8 is performed; as the pressure within the pressure chamber 12 drops, the inlet valve engaging member 201 is engaged with the inlet valve 5 in response to the biasing force of the valve opening spring 202 to move in the valve opening direction; and the inlet valve 5 synchronizes to the reciprocation of the plunger 2 to automatically open the valve, and the valve opened state of the inlet valve 5 is held. Thus, within the pressure chamber 12, the pressure has dropped, whereby the discharge valve 6 is not opened. Thereafter, the above-described operation will be repeated.

For this reason, when in the course of a compression stroke before the plunger reaches the top dead center, the solenoid 200 is caused to be in an ON state, the fuel is pumped to the common rail 53 from this time; if pumping of the fuel is once started, since the pressure within the pressure chamber 12 has risen, even if the solenoid 200 is turned OFF thereafter, the inlet valve 5 maintains its blocked state, and on the other hand, can automatically open the valve in synchronization with the beginning of the suction stroke; and the discharge of the fuel to the common rail 53 side can be adjusted by output timing of an ON signal of the solenoid 200. Further, on the basis of a signal from the pressure sensor 56, the control unit 515 operates adequate energizing ON timing, and the solenoid 200 is controlled, whereby the pressure of the common rail 53 can be feedback-controlled to the target value.

Figure 7:
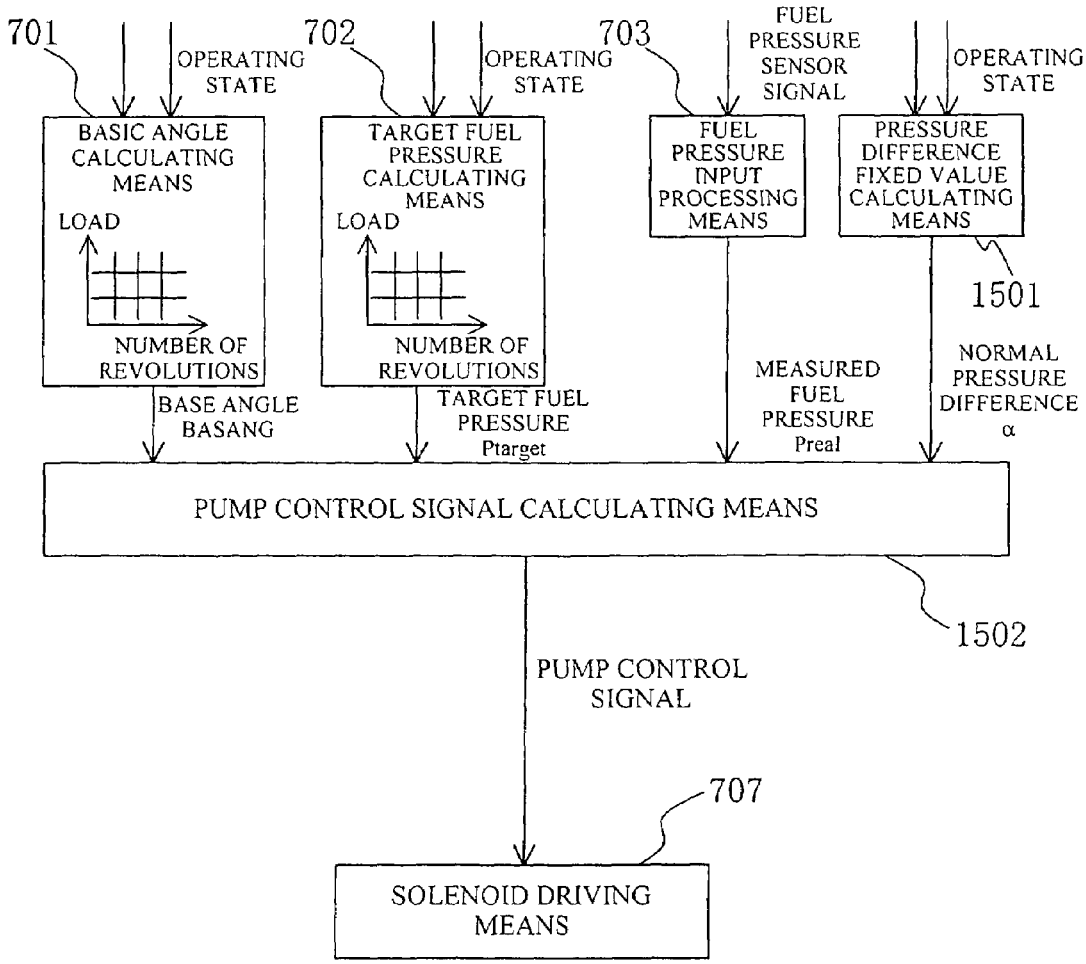
FIG. 7 is a block diagram showing basic control by the control device of a high-pressure fuel pump of FIG. 1.

FIG. 7 is a control block diagram showing control of the high-pressure fuel pump 1 which MPU603 of the control unit 515 having the control device of a high-pressure fuel pump performs. The control device of a high-pressure fuel pump is composed of basic angle calculating means 701, target fuel pressure calculating means 702, fuel pressure input processing means 703, pressure difference fixed value calculating means 1501, and pump control signal calculating means 1502 having means for calculating a drive signal of the solenoid 200 as its one aspect.

Figure 8:
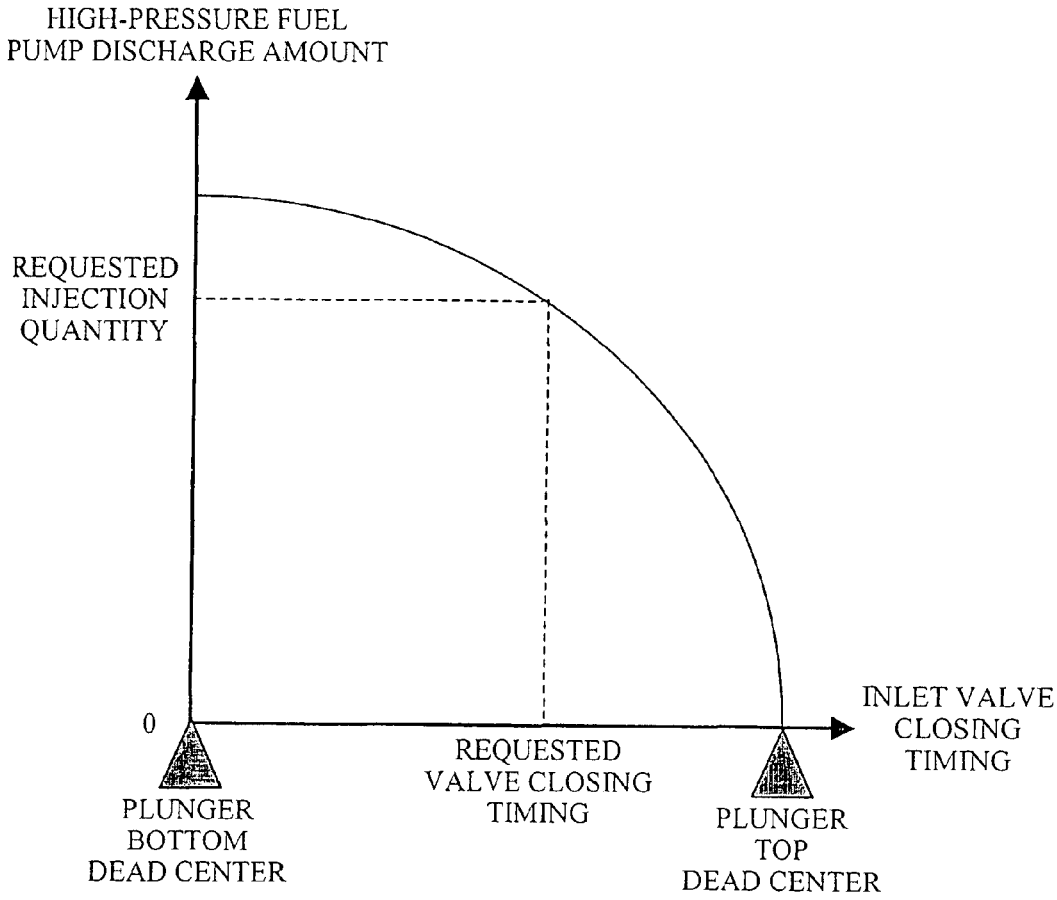
FIG. 8 is a view showing characteristics of discharge flow rate in the high-pressure fuel pump of FIG. 3.

The basic angle calculating means 701 operates a basic angle BASANG of a solenoid control signal for setting the solenoid 200 to an ON-state on the basis of the operating state to output to the pump control signal calculating means 1502. FIG. 8 shows relationship between valve closing timing of the inlet valve 5 and the discharge amount of the high-pressure fuel pump, and as understood from FIG. 8, the basic angle BASANG sets an angle that the inlet valve 5 closes such that the requested fuel injection amount and the high-pressure fuel pump discharge amount balance.

The target fuel pressure calculating means 702 likewise calculates target fuel pressure Ptarget optimum to its working point on the basis of the operating state to output to the pump control signal calculating means 1502. The fuel pressure input processing means 703 filter-processes a signal from the fuel pressure sensor 56 and detects measured fuel pressure Preal, that is actual fuel pressure, to output to the pump control signal calculating means 1502. Further, the pressure difference fixed value calculating means 1501 operates a normal pressure difference $\alpha$ in response to the operating state in order to judge an operation of the high-pressure fuel pump 1, and outputs to the pump control signal calculating means 1502.

Thus, the pump control signal calculating means 1502 operates, as described later, the solenoid control signal, that is an actuator drive signal, on the basis of each of the signals to output to the solenoid driving means 707.

Figure 9:
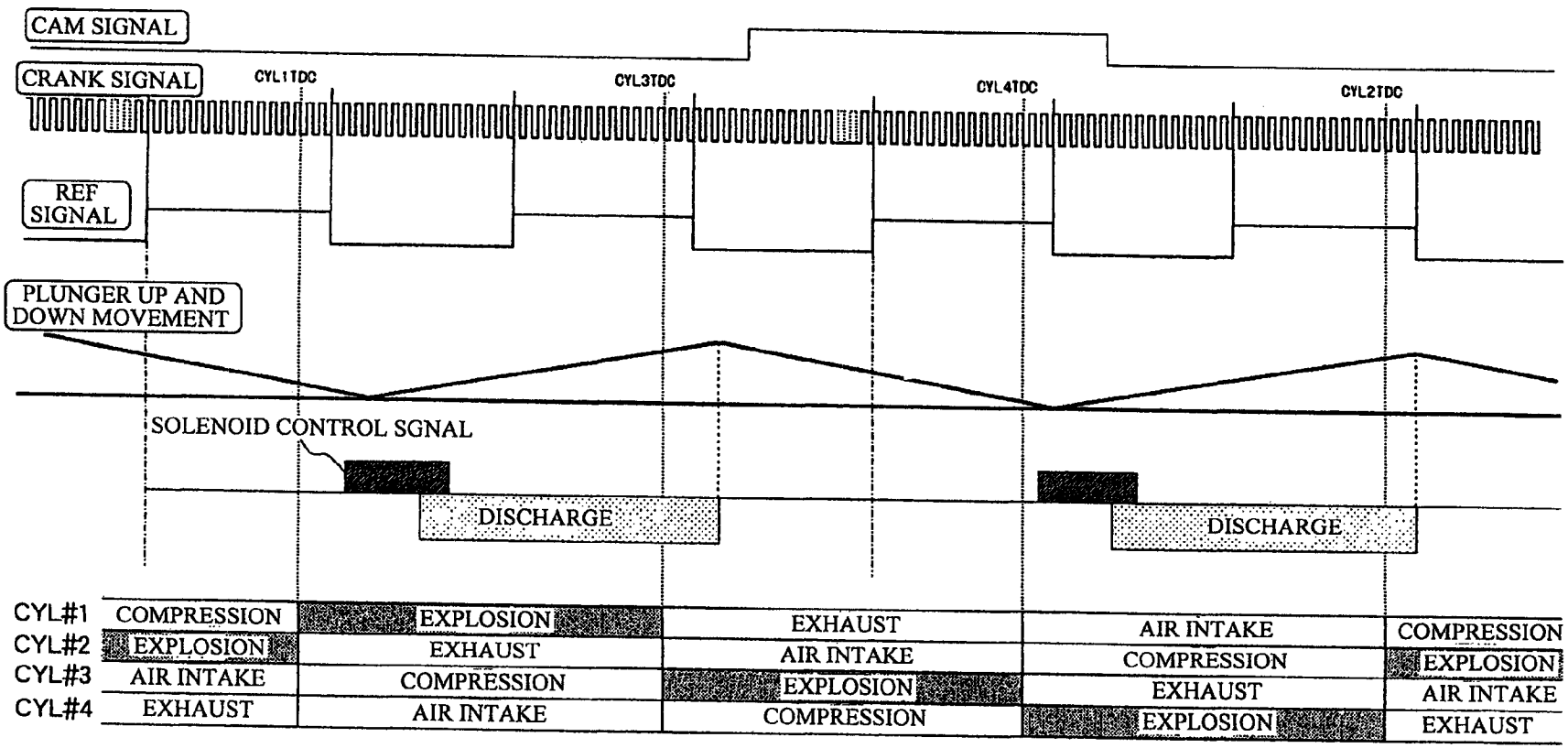
FIG. 9 is a basic operation timing chart of the control device of a high-pressure fuel pump of FIG. 1

FIG. 9 shows an operation timing chart of the control unit 515 (including the control device of a high-pressure fuel pump). The control unit 515 detects a position of the top dead center of each piston 507*a* on the basis of a detection signal (CAM signal) from the cam angle sensor 511 and a detection signal (CRANK signal) from the crank angle sensor 516 to perform fuel injection control and ignition timing control, and detects a stroke of the plunger 2 of the high-pressure fuel pump 1 on the basis of the detection signal (CAM signal) from the cam angle sensor 511 and the detection signal (CRANK signal) from the crank angle sensor 516 to perform solenoid control that is fuel discharge control of the high-pressure fuel pump 1. In this respect, the REF signal that becomes a basic point of the solenoid control, is generated on the basis of the CRANK signal and the CAM signal.

In this case, a portion (indicated by a dotted line) in which the CRANK signal of FIG. 8 is lacking becomes a reference position, and is located at a position deviated from the top dead center of CYL#1 or the top dead center of CYL#4 by a distance corresponding to a predetermined phase. Thus, when the CRANK signal is lacking, the control unit 515 distinguishes the CYL#1 or CYL#4 side depending upon whether the CAM signal is Hi or Lo. Discharge of the fuel from the high-pressure fuel pump 1 is started after a lapse of a predetermined time period corresponding to working delay of the solenoid 200 from a rise of the solenoid control signal. On the other hand, since the inlet valve 5 has been pressed by pressure from the pressure chamber 12 even if the solenoid control signal is terminated, this discharge will be continued until the plunger stroke reaches the top dead center.

Figure 10:
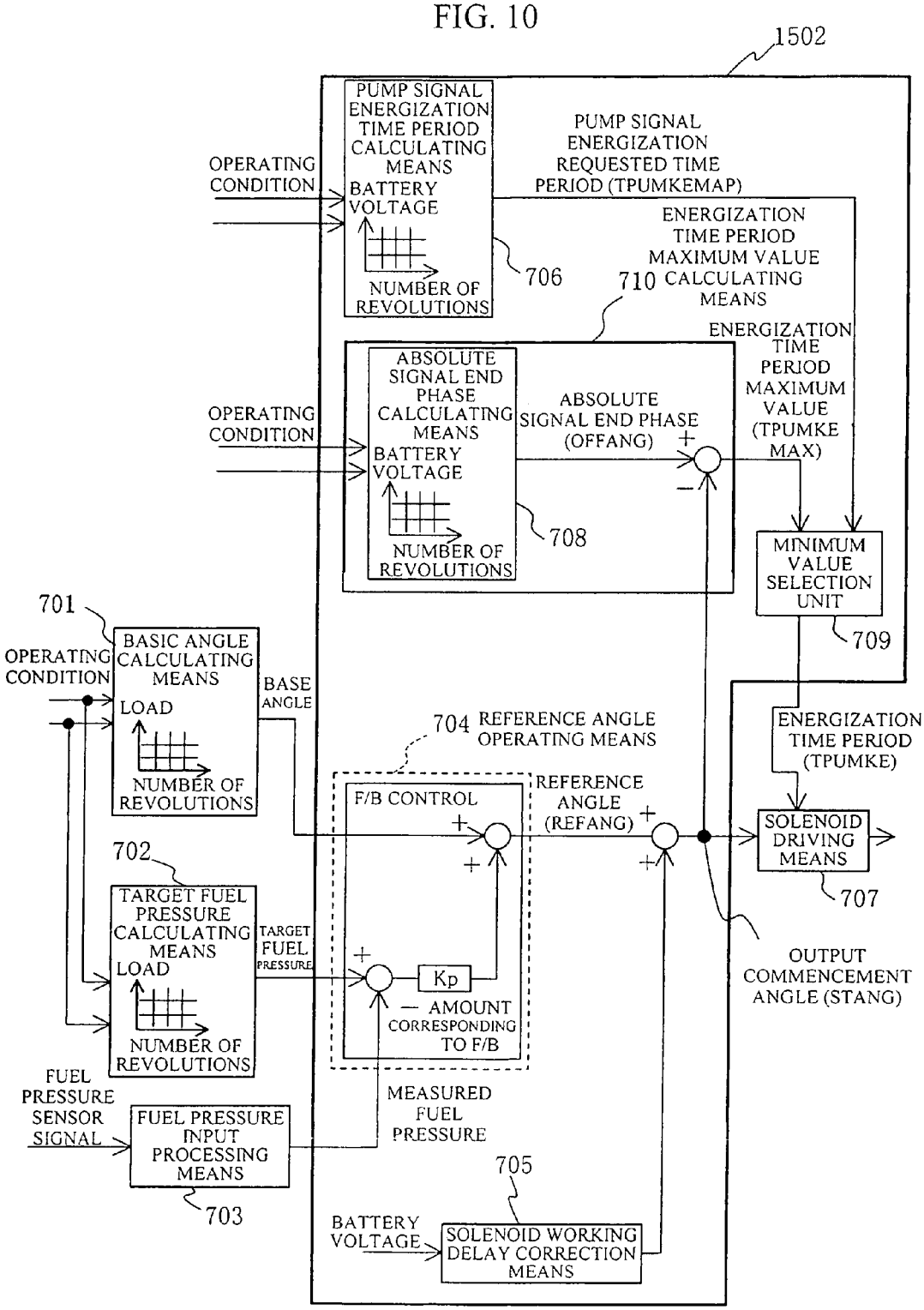
FIG. 10 is a control block diagram of pump control signal calculating means of the control device of a high-pressure fuel pump of FIG. 1.

FIG. 10 is a control block diagram specifically showing pump control signal calculating means 1502 according to the present embodiment. The pump control signal calculating means 1502 is basically constructed of reference angle operating means 704 for operating the timing of an ON-signal of the solenoid 200, and pump signal energization time period calculating means 706 for calculating the width of the ON-signal. The reference angle operating means 704 operates a reference angle REFANG that becomes a reference of output commencement of the ON-signal on the basis of the basic angle BASANG of the basic angle calculating means 701, the target fuel pressure Ptarget of the target fuel pressure calculating means 702 and the measured fuel pressure Preal of the fuel pressure input processing means 703.

Thus, the reference angle operating means 704 calculates an output commencement angle STANG of an ON-signal of the solenoid 200 by adding an amount PUMRE corresponding to correction for the working delay by solenoid working delay correction means 705 to the reference angle REFANG to output to the solenoid driving means 707 as timing of the ON-signal of the solenoid 200.

Also, the pump signal energization time period calculating means 706 operates energization requested time period TPUMKEMAP of the solenoid 200 of the high-pressure fuel pump 1 on the basis of the operating condition. For a value of the energization requested time period TPUMKEMAP, there is set a value at which the inlet valve engaging member 201 is held until the inlet valve 5 can be closed at the pressure within the pump chamber 2 and the inlet valve 5 can be reliably closed even under the worst condition in which a solenoid attraction force having low battery voltage and high solenoid resistance occurs. On the other hand, in an energization time period maximum value calculating means block 710, there will be operated energization time period maximum value TPUMKEMAX for not maintaining an attraction force of the solenoid up to the next discharge stroke. A minimum value selection unit 709 selects minimum values for the energization requested time period TPUMKEMAP and the energization time period maximum value TPUMKEMAX to output to the solenoid driving means 707 as the energization time period TPUMKE. In other words, the upper limit value of the energization requested time period TPUMKEMAP will be limited by the energization time period maximum value TPUMKEMAX.

Thus, with the above-described output commencement angle STANG and energization time period TPUMKE, the solenoid 200 will be driven. In this case, the solenoid working delay correction means 705 calculates the solenoid working delay correction on the basis of the battery voltage because an electromagnetic force of the solenoid 200, in its turn, the working delay time is changed by the battery voltage.

Next, the specific description will be made of a first example within the energization time period maximum value calculating means 710. Absolute signal end phase calculating means 708 operates an angle OFFANG from a basic point (REF signal) in which an energization signal must have been absolutely made OFF. As regards this angle, in order to reduce the consumption current, an angle OFFAMG from the basic point (REF signal) is set to an angle from the basic point to the top dead center of the plunger or less because even if a signal that has started energization in the discharge stroke of the high-pressure pump may be continued to be ON up to the pump suction stroke, the energization in the suction stroke in this case has nothing to do with closing of the inlet valve. In addition, there will be set an angle at which the attraction force of the solenoid after the energization signal is made OFF will not be maintained up to the next discharge stroke.

Figure 11:
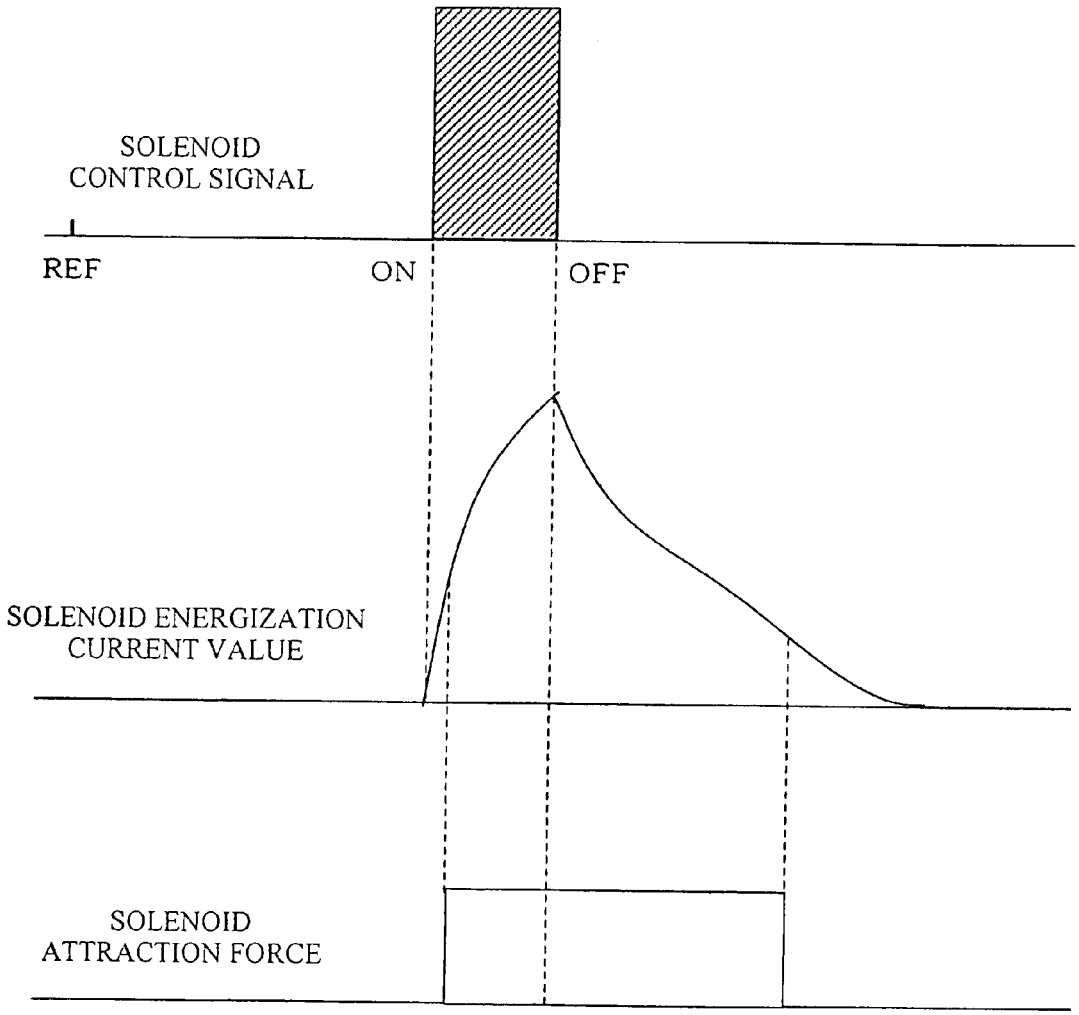
FIG. 11 is a view showing relationship between a solenoid control signal and an attraction force in the high-pressure fuel pump of FIG. 3.

Also, FIG. 11 is a view showing relationship between the solenoid control signal (energization signal), an energization current value, and an attraction force of the solenoid, and after the energization signal is OFF, a current flows through the solenoid during a fixed time period, and the attraction force is maintained until the current falls to a predetermined value or less. This period depends upon the coil resistance and the battery voltage. Also, since phase control has been performed, it becomes also necessary to input a number of revolutions in order to convert the period into the angle in unit. In other words, an angle OFFANG from the basic point (REF signal) will be operated through the use of at least one of the coil resistance, the battery voltage and the number of revolutions.

Figure 12:
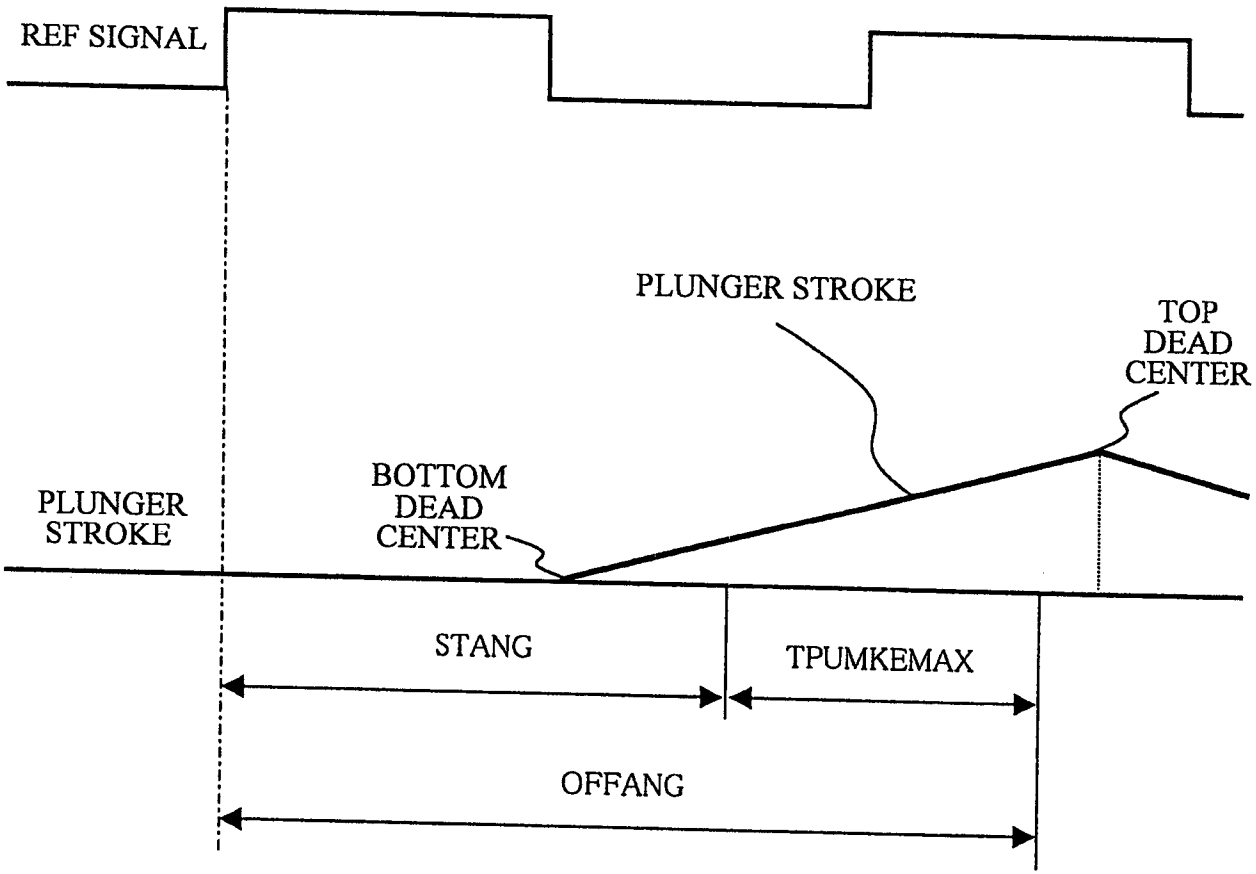
FIG. 12 is an auxiliary explanatory view of pump control signal calculating means of the control device of a high-pressure fuel pump of FIG. 10.

FIG. 12 shows relationship between the output commencement angle STANG, an angle OFFANG from the basic point (REF signal), and the energization time period maximum value TPUMKEMAX. A difference between the angle OFFANG from the basic point (REF signal) and the output commencement angle STANG becomes the energization time period maximum value TPUMKEMAX.

Figure 13:
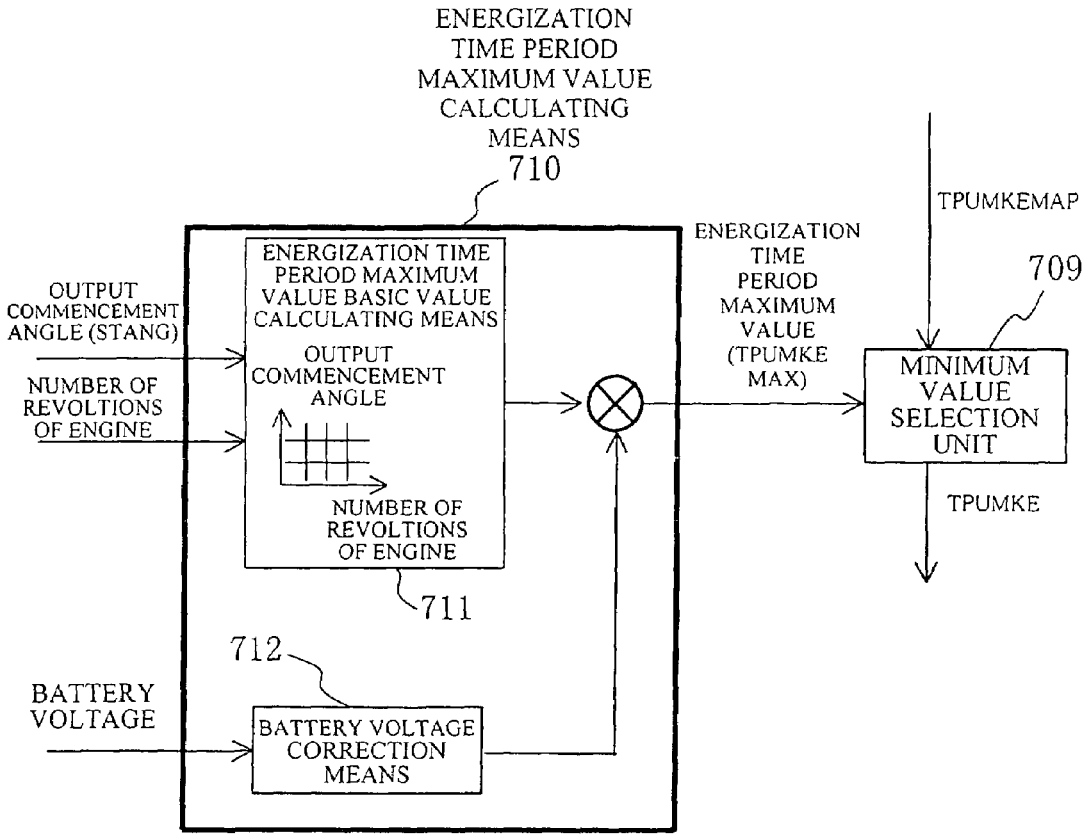
FIG. 13 is a basic control block diagram of another example of energization time period maximum value calculating means in pump control signal calculating means of FIG. 10.

FIG. 13 shows the second example within energization time period maximum value calculating means 710. Energization time period maximum value basic value calculating means 711 calculates the energization time period maximum value basic value from an output commencement angle STANG to be determined from the injection quantity, the engine number of revolutions, the fuel pressure and the like, and the engine number of revolutions. By multiplying the energization time period maximum value basic value by a battery voltage correction factor calculated by the battery voltage correction means 712, the energization time period maximum value basic value calculating means 711 calculates the energization time period maximum value to output to the minimum value selection unit 709.

Figure 14:
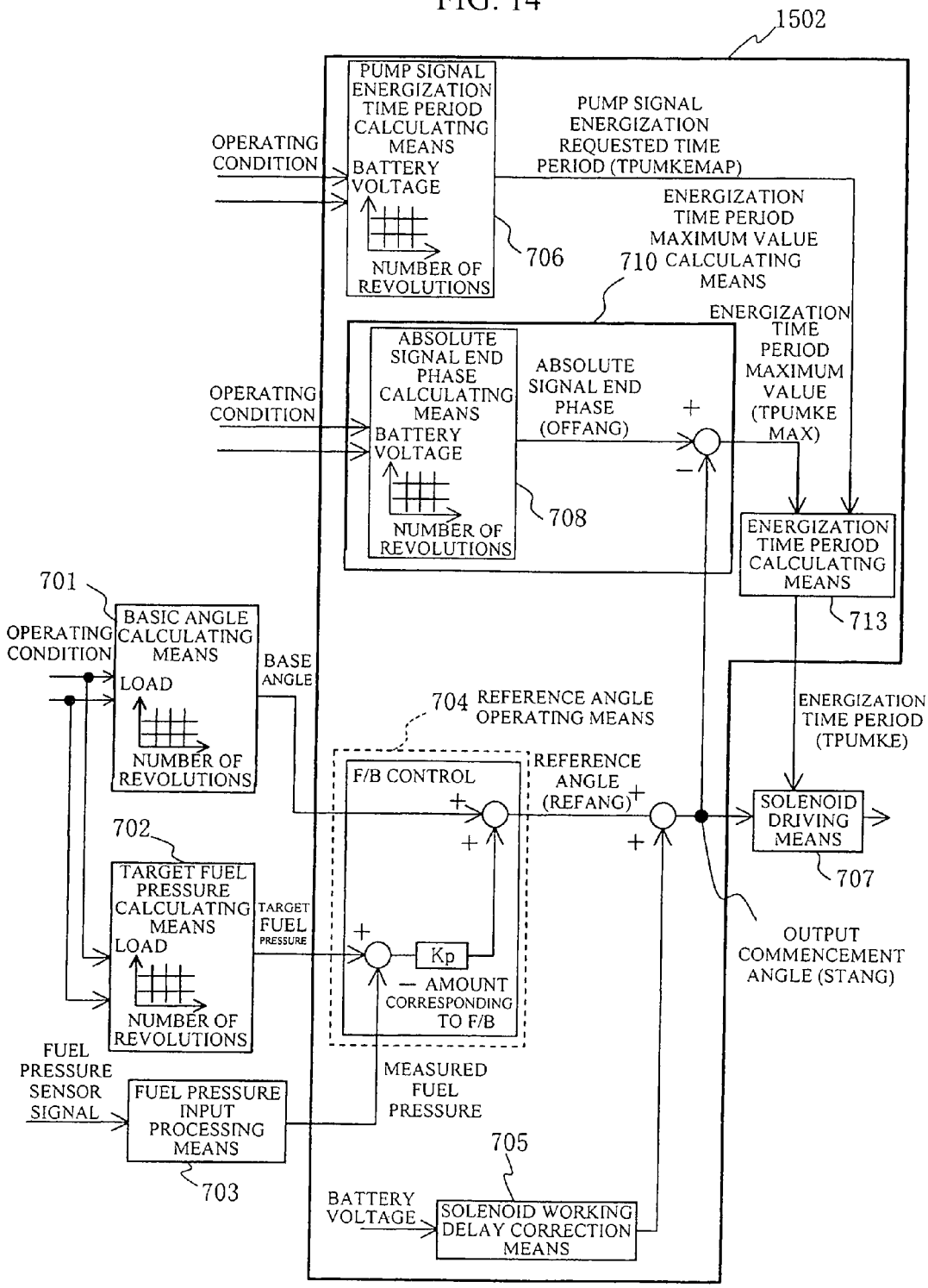
FIG. 14 is a control block diagram of pump control signal calculating means in the control device of a high-pressure fuel pump according to a second embodiment of the present invention.

FIG. 14 shows pump control signal calculating means 1502 according to the second embodiment of the present invention, and a difference from the pump control signal calculating means 1502 according to the first embodiment is that there is provided energization time period calculating means 713 in place of the minimum value selection unit 709 (See FIG. 10). The energization time period calculating means 713 calculates energization time TPUMKE on the basis of TPUMKEMAP calculated by the pump signal energization time period calculating means 706, and TPUMKEMAP calculated by the energization time period maximum value calculating means 710, and outputs to the solenoid driving signal.

Figure 15:
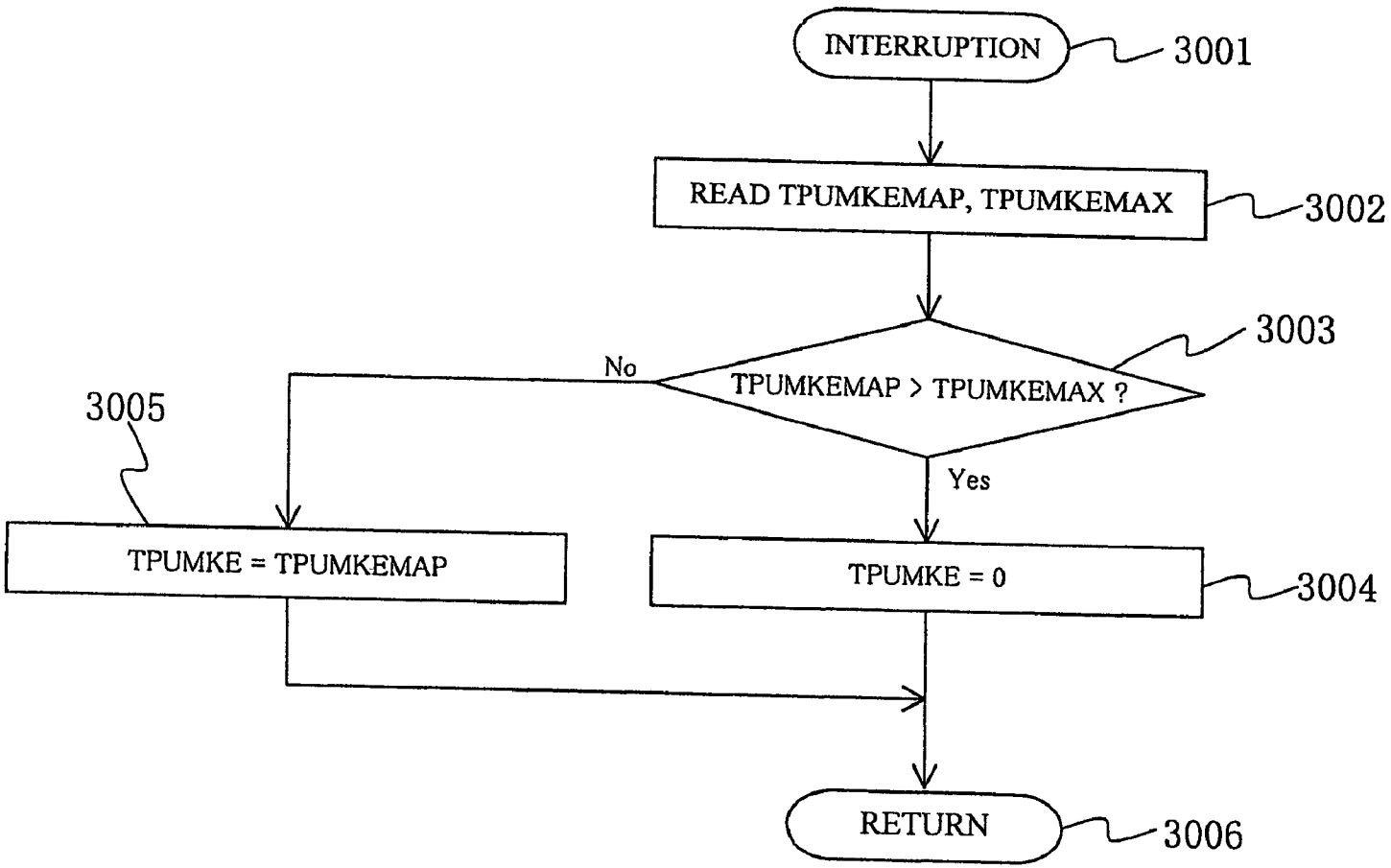
FIG. 15 is an operation flow chart of the control device of a high-pressure fuel pump of FIG. 10.

FIG. 15 shows a control flow in the energization time period calculating means 713. At a step 3001, interruption processing is started. The interruption processing may be of such a time period as, for example, every 10 ms, or may be of a rotary period like, for example, every the crank angle of 180 deg. In a step 3002, the energization requested time period TPUMKEMAP and the energization time maximum value TPUMKEMAX are read in. In a step 3003, large and small relationship between the energization requested time period TPUMKEMAP and the energization time period maximum value TPUMKEMAX is judged, and when the energization time period maximum value. TPUMKEMAX is larger, it is outputted as pump phase control signal energization time period TPUMKE=TPUMKEMAP. On the other hand, when the energization time period maximum value TPUMKEMAX is smaller, it is judged impossible to output energization requested time period TPUMKEMAP, and energization to the solenoid is forbidden as the pump phase control signal energization time period TPUMKE=0.

In processing by the pump control signal calculating means 1502, there may be satisfied a relation of energization requested time period TPUMKEMAP of the solenoid 200>the energization time period TPUMKE. In this case, in the worst condition in which solenoid attraction force occurs, there is a possibility that the inlet valve cannot be reliably closed, and the inlet valve cannot be reliably closed, whereby there is a possibility that the pump cannot pump, but pulsation of the fuel pressure is intensified.

Figure 16:
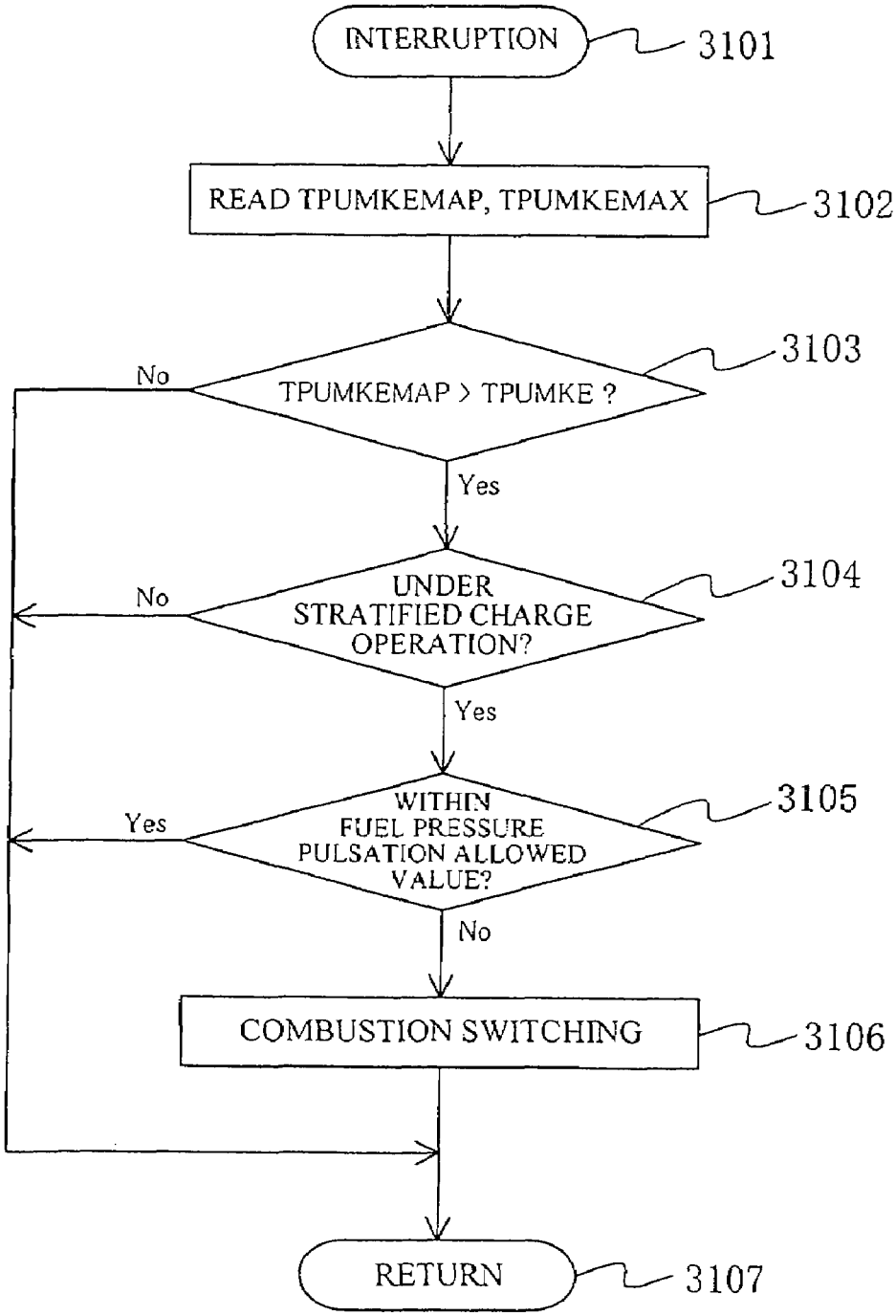
FIG. 16 is a control flow chart when there is a possibility that a pump in a control device of an internal combustion engine according to each embodiment of the present invention cannot pump, but the fuel pressure pulsates.

FIG. 16 shows a control flow when there is a possibility that the pump cannot pump, but the fuel pressure pulsates.

At a step 3101, interruption processing is started. The interruption processing may be of such a time period as, for example, every 10 ms, or may be of a rotary period like every the crank angle of 180 deg. In a step 3102, the energization requested time period TPUMKEMAP and the energization time period TPUMKE are read in. Between a step 3103 and a step 3105, when the energization time period TPUMKE is smaller than the energization requested time period TPUMKEMAP, a stratified charge combustion operation is performed and it is judged that there is a possibility of an accidental fire due to pulsation, the sequence will proceed to an uniform combustion operation resistant to fluctuation of fuel pressure.

Figure 17:
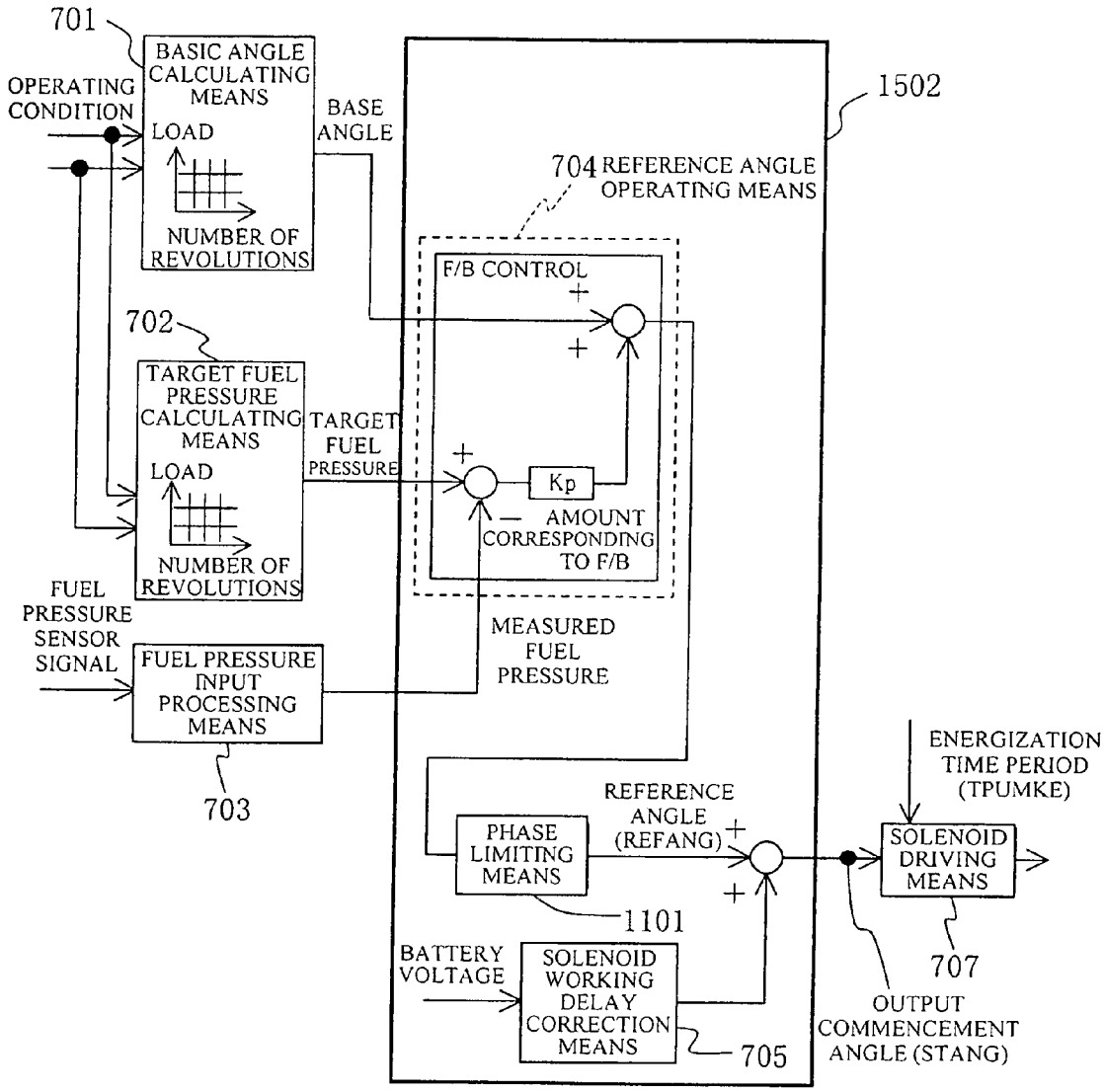
FIG. 17 is a control block diagram showing pump control signal calculating means according to a third embodiment of the present invention.

FIG. 17 is a control block diagram showing a third embodiment of the present invention concerning processing by the pump control signal calculating means 1502. The pump control signal calculating means 1502 top- and -bottom limits, on calculating a reference angle REFANG, a phase operated by the reference angle operating means 704 by phase limiting means 1101, and regards this as a reference angle REFANG. In this respect, the phase limiting means 1101 can be applied to pump control having a variable capacity mechanism by phase control.

Figure 18:
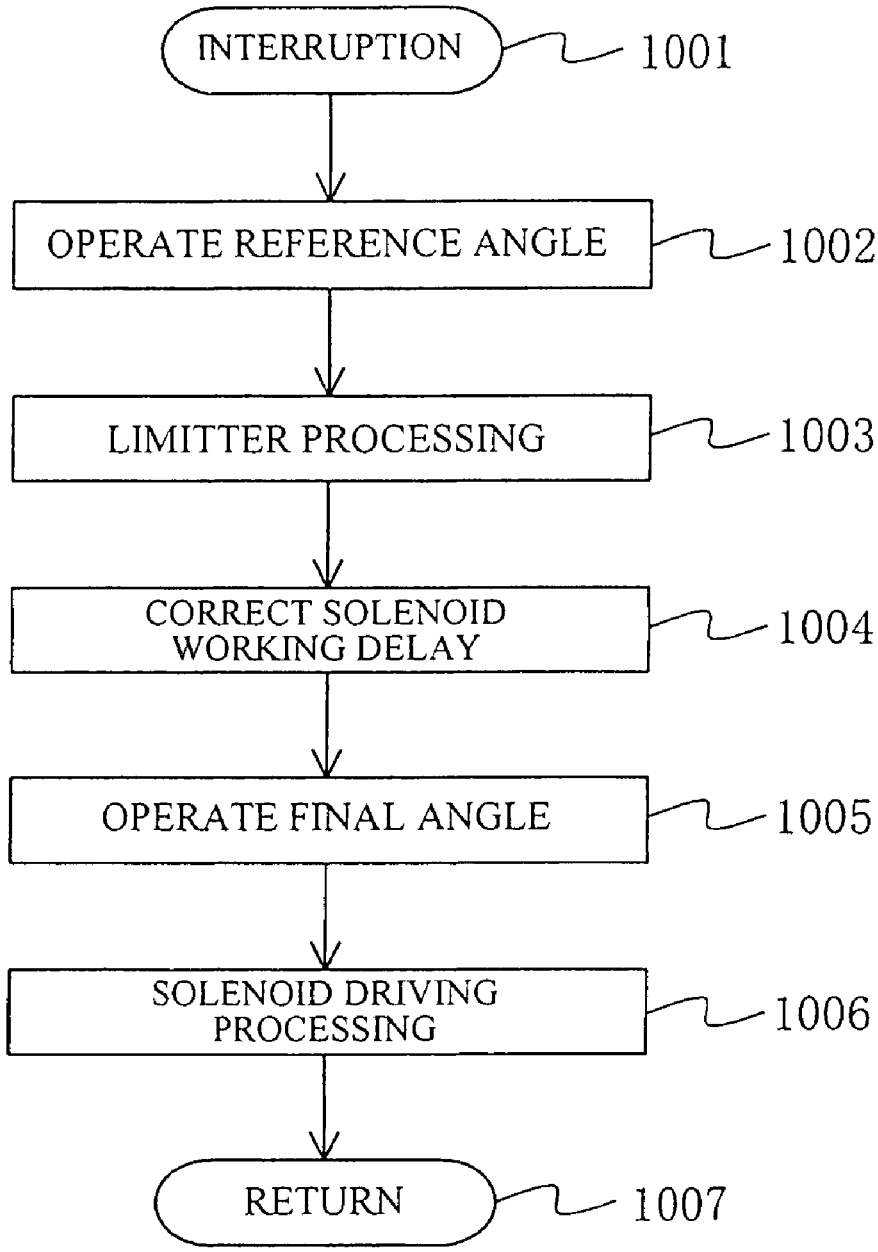
FIG. 18 is an operation flow chart of the pump control signal calculating means of FIG. 17.

FIG. 18 is a flow chart showing control of the high-pressure fuel pump 1 by the control device of the high-pressure fuel pump. In a step 1001, the interruption processing synchronized to time like, for example, every 10 ms is performed. In this respect, for the interruption processing, a processing synchronized to rotation like every the crank angle of 180 deg may be used.

In a step 1002, the phase is operated by the reference angle operating means 704; in a step 1003, limiter processing of the upper and lower limits is performed by the phase limiting means 1101 to set to the reference angle REFANG; in a step 1004, a portion for the solenoid working delay correction PUMRE is corrected by solenoid working delay correction means 705; in a step 1005, a final output commencement angle STANG is calculated, and in a step 1006, solenoid driving processing is performed by solenoid driving means 707 to output a pulse of a solenoid control signal. In this respect, a method for calculating the output commencement angle STANG may, in addition to the method for calculating for each interruption as described above, be a method for retrieving in the state of the internal combustion engine. Thus, the sequence will proceed to a step 1007 to complete a series of operations.

Figure 19:
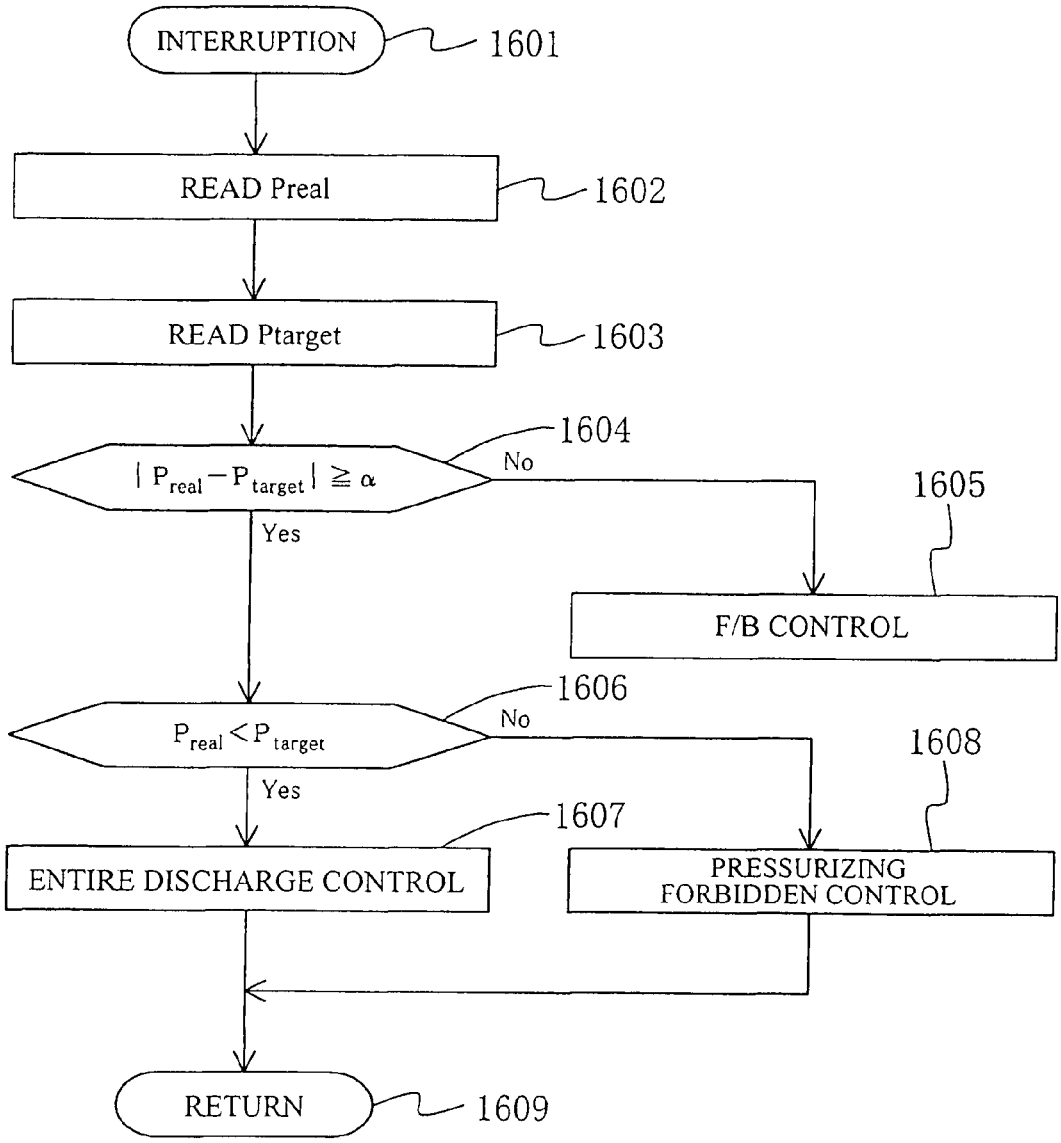
FIG. 19 is a control flow chart showing processing for increasing stability of a high-pressure fuel supply system in the pump control signal calculating means of FIG. 17.

FIG. 19 is a control flow chart showing a process for increasing stability of the high-pressure fuel supply system in the pump control signal calculating means 1502. In this respect, a high-pressure pump for use with the high-pressure fuel supply system at this time means a pump capable of discharging high-pressure fuel, and may be, in addition to a single-cylinder pump according to the present embodiment, for example, a so-called three-cylinder pump.

In a step 1601, there is performed the interruption processing synchronized to time like, for example, every 10 ms. In this respect, for the interruption processing, a processing synchronized to rotation like every the crank angle of 180 deg may be used. In a step 1602, measured fuel pressure Preal is read in by the fuel pressure input processing means 703, and in a step 1603, the target fuel pressure Ptarget in the system is read in by the target fuel pressure calculating means 702. In a step 1604, it is judged whether or not an absolute value of a pressure difference between the target fuel pressure Ptarget and the measured fuel pressure Preal exceeds a fixed value $\alpha$ obtained by retrieving in response to a state of the internal combustion engine by pressure difference fixed value calculating means 1501.

Thus, when the pressure difference between those two exceeds the fixed value $\alpha$, that is, when affirmative, the sequence will proceed to a step 1606. On the other hand, when the pressure difference between those two is under the fixed value $\alpha$, the sequence will proceed to a step 1605, and F/B control will be performed as usual so as to cause the measured fuel pressure Preal to follow the target fuel pressure Ptarget.

In the step 1606, it is judged whether or not the target fuel pressure Ptarget is higher than the measured fuel pressure Preal, and when the target fuel pressure Ptarget is higher, that is, when affirmative, the sequence will proceed to a step 1607 to control the entire discharge from the bottom dead center of the plunger 2, and the sequence will proceed to a step 1609 to complete a series of operations. In other words, in this case, the high-pressure fuel pump 1 is caused to discharge the whole, whereby the measured fuel pressure Preal can be brought close to the target fuel pressure Ptarget swiftly.

On the other hand, when the measured fuel pressure Preal is higher in the step 1606, the sequence will proceed to a step 1608 to perform pressurizing-forbidden control by the high-pressure fuel pump 1. In other words, in this case, an OFF signal is outputted or an ON-signal is outputted at the top dead center of the plunger 2, and pressurizing by the high-pressure fuel pump 1 is forbidden, whereby the measured fuel pressure can be brought close to the target fuel pressure swiftly.

Also, when an abnormal condition is encountered in the high-pressure piping system and the fuel pressure rises higher than the fixed value, this is capable of contributing to the improved safety of the system because the high-pressure fuel pump 1 is prohibited from pressurizing and the fuel pressure is restrained from rising.

Figure 20:
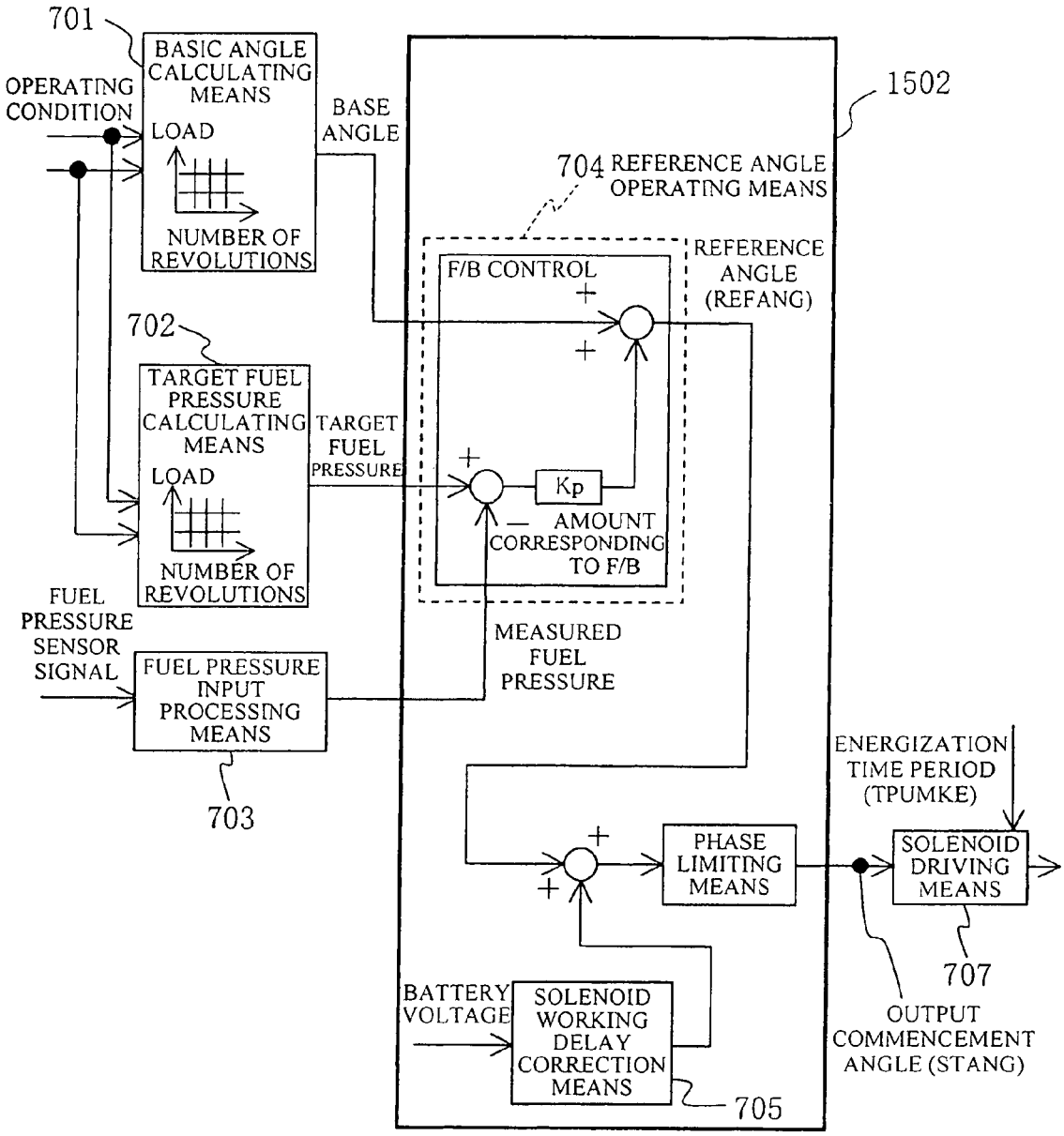
FIG. 20 is a control block diagram of the pump control signal calculating means according to a fourth embodiment of the present invention.

Also, although the pump control signal calculating means 1502 according to the above-described embodiment has calculated the reference angle REFANG by limiting a phase obtained by calculating by the reference angle operating means 704, by the phase limiting means 1101, the present invention is not limited thereto, but as in the case of the fourth embodiment shown in, for example, FIG. 20, it may be possible to finally limit the output commencement angle STANG obtained by calculating by the phase limiting means 1301 by taking account of correction in the solenoid working delay correction means 705 to the reference angle REFANG of the reference angle operating means 704.

Figure 21:
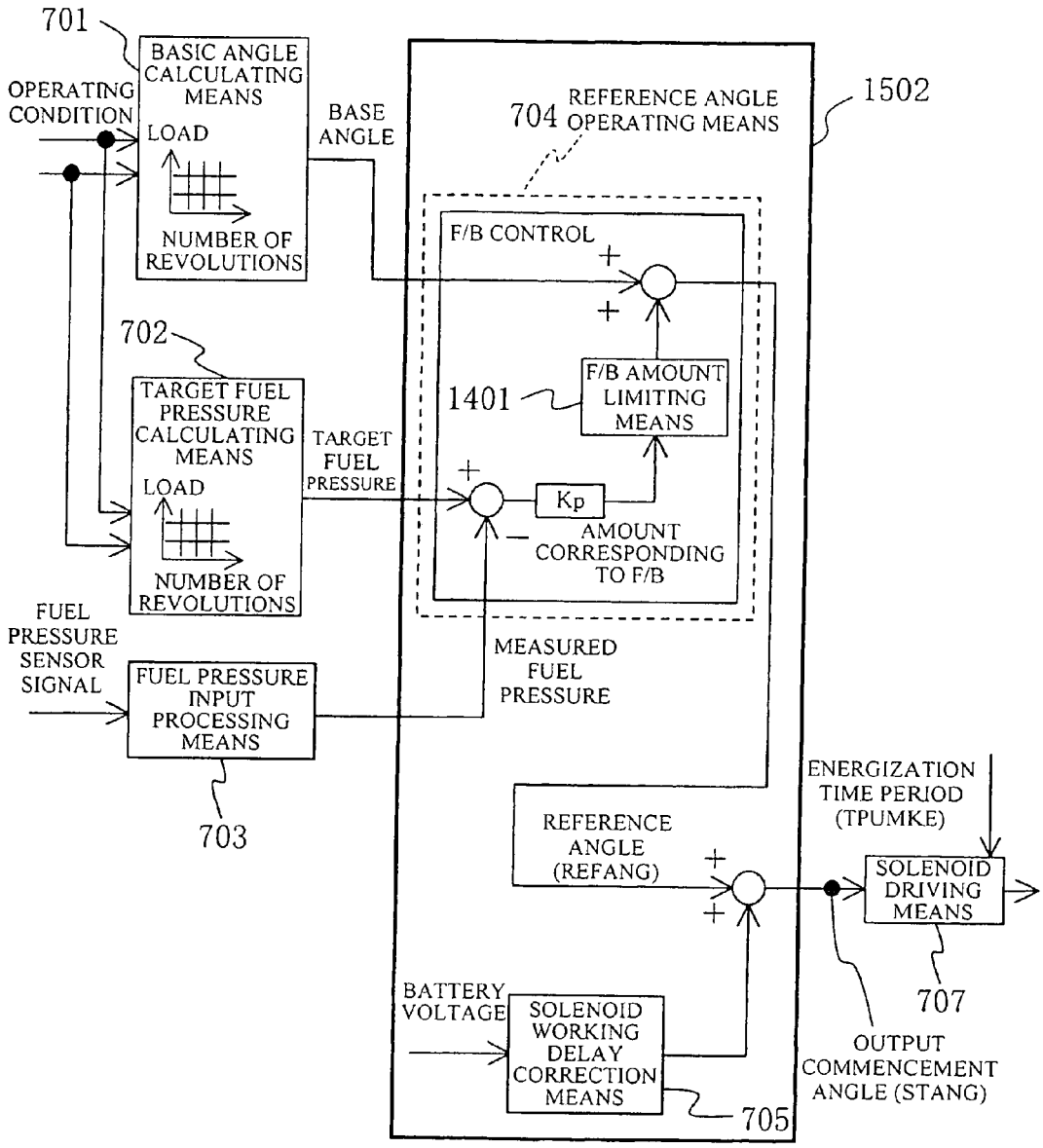
FIG. 21 is a control block diagram of the pump control signal calculating means according to a fifth embodiment of the present invention.
Figure 22:
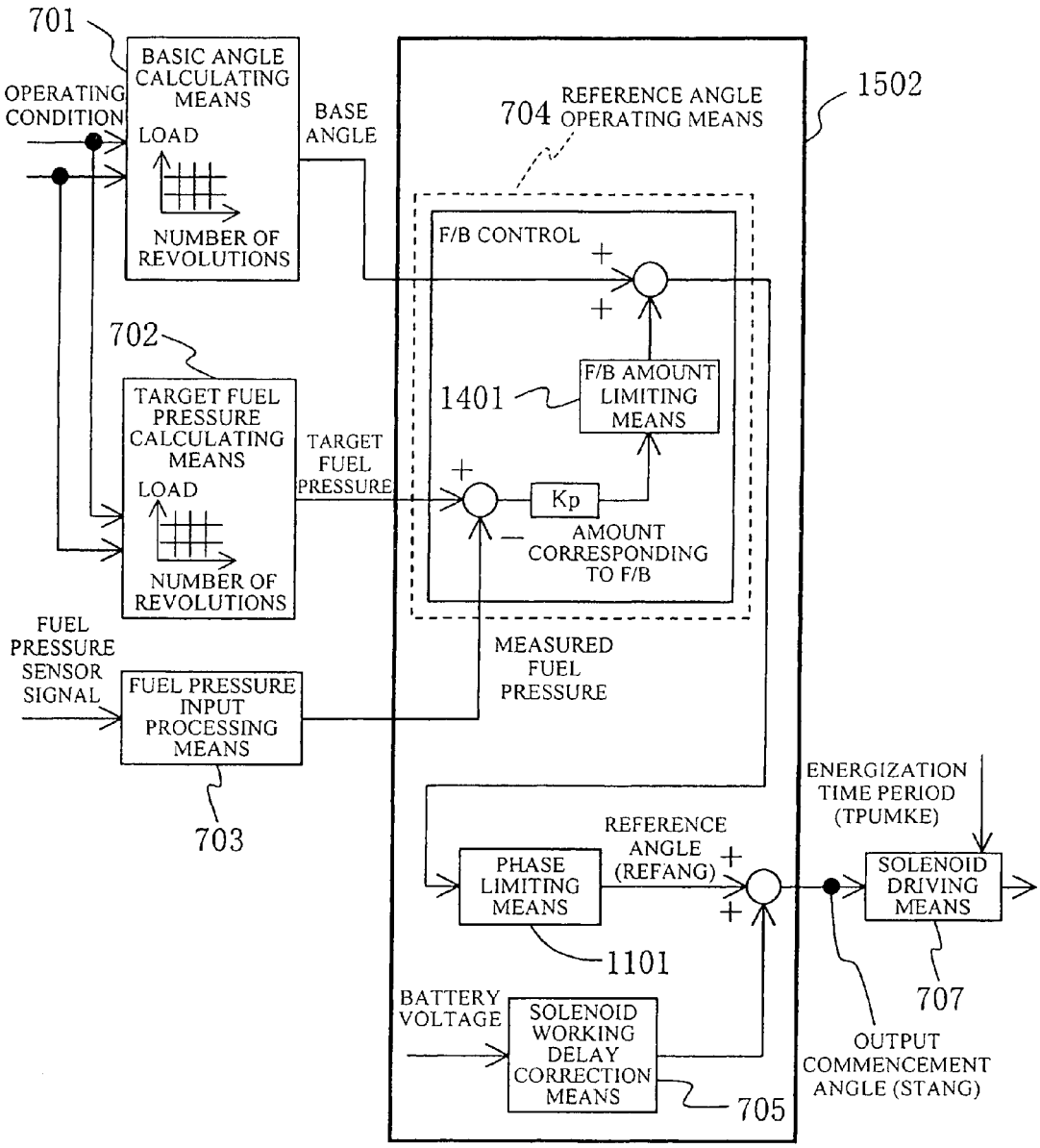
FIG. 22 is a control block diagram of the pump control signal calculating means according to a sixth embodiment of the present invention.

Further, as shown in the fifth embodiment of FIG. 21, it is also possible to limit an amount of F/B control of the reference angle operating means 704 by the F/B limiting means 1401 into the reference angle REFANG, and as shown in the sixth embodiment of FIG. 22, it may be possible to limit the amount of F/B control of the reference angle operating means 704 by the F/B limiting means 1401, and to also limit this value by the phase limiting means 1101 into the reference angle REFANG.

In this respect, the F/B control is feedback control for causing the actual fuel pressure of the common rail 53 to follow the target fuel pressure, and this amount of F/B control changes due to deviations of the target fuel pressure Ptarget and the actual fuel pressure Preal. Also, it may be possible to limit an amount of control for causing the actual fuel pressure to coincide with the target fuel pressure.

Also, although the phase limiting means 1101 of the above-described embodiment limits the phase by only the lower limit value or the upper limit value and the lower limit value into a phase capable of pumping the fuel, in addition to this, it may be possible to retrieve/operate the output phase range in response to the state of the internal combustion engine, or it may be possible to use an electronic circuit. In this case, the similar effect to the foregoing can be also obtained.

Figure 23:
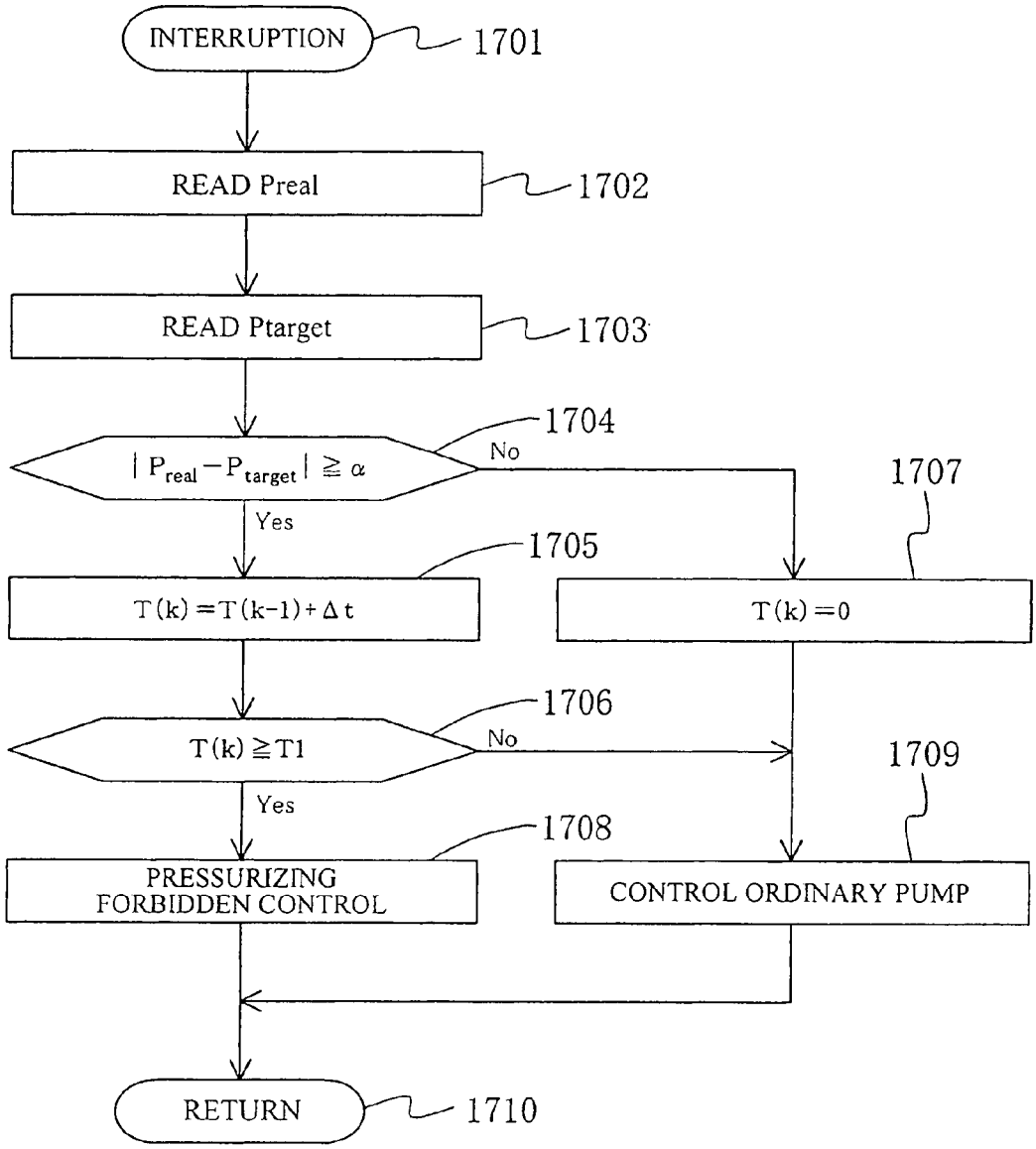
FIG. 23 is another control flow chart showing processing for increasing stability of a high-pressure fuel supply system in the pump control signal calculating means of FIG. 22.

Further, although the pump control signal calculating means 1502 of the above-described embodiment has increased the stability of the high-pressure fuel supply system from the target fuel pressure Ptarget and the measured fuel pressure Preal, it may be possible to perform as shown in such a flow chart of control processing as shown in FIG. 23.

In other words, in a step 1701, the interruption processing synchronized to time like, for example, every 10 ms is performed; in a step 1702, measured fuel pressure Preal is read in by the fuel pressure input processing means 703; and in a step 1703, the target fuel pressure Ptarget in the system is read in by the target fuel pressure calculating means 702. In a step 1704, it is judged whether or not a pressure difference between the target fuel pressure Ptarget and the measured fuel pressure Preal exceeds a fixed value $\alpha$ by pressure difference fixed value calculating means 1501. The description to this point is similar to the step 1601 to the step 1604.

Thus, when the pressure difference between those two exceeds the fixed value $\alpha$, that is, when affirmative, the sequence will proceed to a step 1705 to perform timer count-up processing, and the sequence will proceed to a step 1706. In the step 1706, it is judged whether or not this time period exceeds a fixed time period T1 obtained by retrieving in response to the state of the internal combustion engine, and when the fixed time period T1 is exceeded, that is, when affirmative, the sequence will proceed to a step 1708 to perform pressurizing-forbidden control by the high-pressure pump 1, and the sequence will proceed to a step 1710 to complete a series of operations. In this respect, the step 1708 has thought of restraining the fuel pressure from rising, and when a fixed time period has elapsed at a fixed pressure difference or higher, it is considered that an abnormal condition has been encountered in the high-pressure piping system. Therefore, by restraining the fuel pressure from rising, this contributes to the improved safety of the system.

On the other hand, in the step 1704, when the pressure difference between those two is under the fixed value α, the sequence will proceed to a step 1707 to perform timer reset processing, and the sequence will proceed to a step 1709. Also, even when the fixed time period T1 has not been exceeded in the step 1706, the sequence will proceed to the step 1709. In the step 1709, ordinary pump control, that is, the F/B control will be performed. Then, the sequence will proceed to the step 1710 to complete a series of operations.

Figure 24:
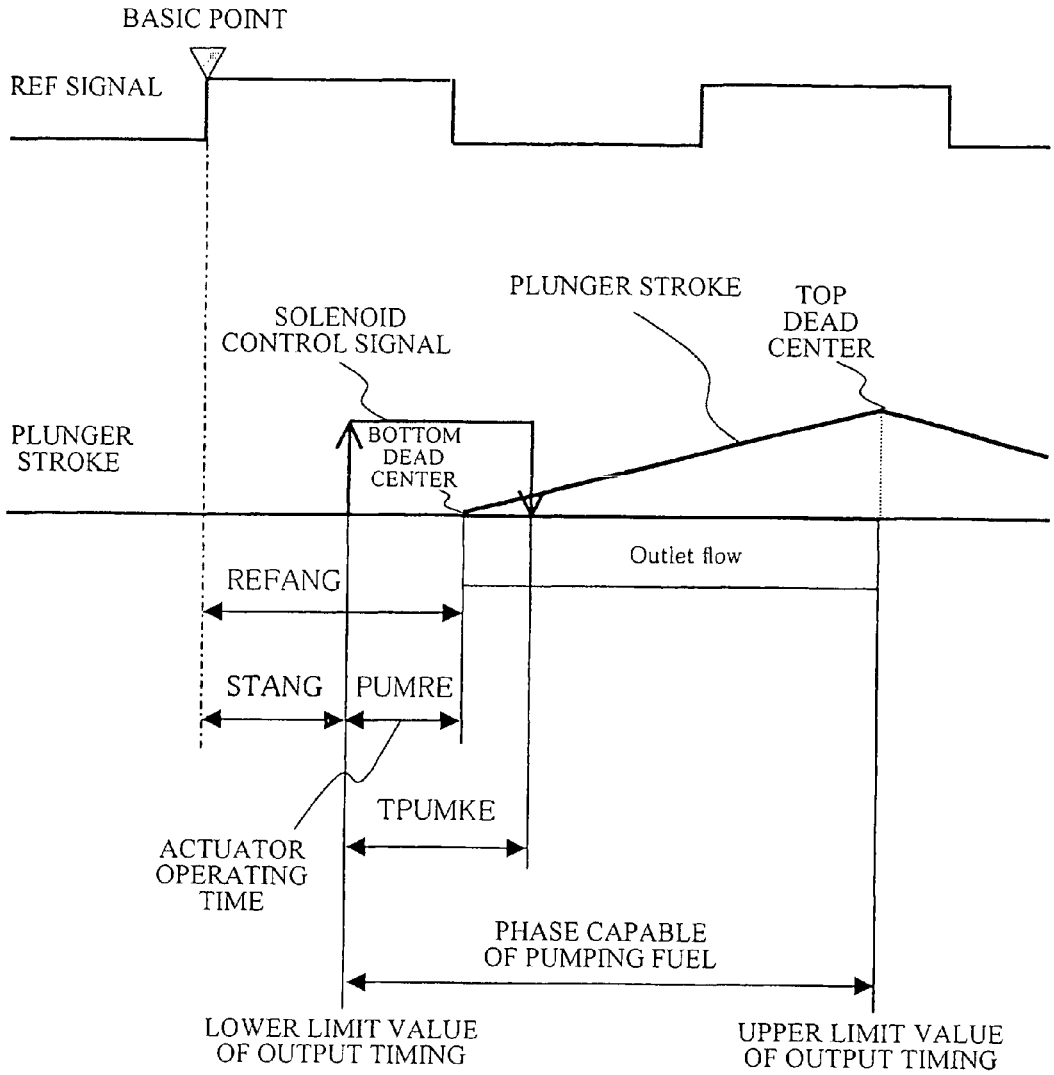
FIG. 24 is a basic operation timing chart of the control device of a high-pressure fuel pump according to each embodiment of the present invention.

FIG. 24 shows parameters such as output commencement angle STANG of the solenoid control signal to the control of fuel pressure by the control unit 515, and the energization time period TPUMKE, and is a view for specifically explaining the control of the pump control signal calculating means 1502 of the third embodiment of FIG. 17 (including FIG. 10). The output commencement angle STANG, that is output timing of an ON-signal of the solenoid 200, can be determined by the following expression (1).

$$STANG=REFANG-PUMRE \quad (1)$$

In this case, the reference angle REFANG is calculated on the basis of the operating state of the internal combustion engine 507 by the reference angle calculating means 704 (FIG. 17). PUMRE is a pump delay angle, is calculated by the solenoid working delay correction means 705 (FIG. 17), and shows an actuator driving time period that changes by, for example, battery voltage, that is, the working delay of the inlet valve engaging member 201 based on solenoid energization.

Next, the pump phase control signal energization time period calculating means 706 (FIG. 10) calculates the pump phase control signal energization time period TPUMKE, that is width of an ON-signal of the solenoid 200, as a basic value on the basis of the operating state. Thus, the pump phase control signal energization time period calculating means 706 determines how far from the basic point, which is a rise of the REF signal, the inlet valve 5 will be caused to be closed on the basis of the output commencement angle STANG, when outputting an ON-signal of the solenoid 200, that is, output timing of the solenoid control signal. On the other hand, on the basis of the pump phase control signal energization time period TPUMKE, how long the solenoid control signal will be continued to be outputted, that is, the width of the solenoid control signal will be determined.

The control device of the high-pressure fuel pump of the present embodiment makes it the basis to energize for a time period that has been calculated from the solenoid control signal output timing calculated, and when the signal end timing exceeds the fixed value, the pump phase control signal energization time period is limited.

Also, a phase to be defined by the pump delay angle PUMRE and a time period that it takes for the stroke of the plunger 2 to reach the top dead center from the bottom dead center is regarded as a phase capable of pumping the fuel, and within that range, an ON-signal of the solenoid 200 is outputted to pump the fuel. In other words, as regards a range in which an ON-signal is transmitted and a signal for closing the inlet valve is outputted, in addition to a time period until the stoke of the plunger 2 reaches the top dead center from the bottom dead center, a point of time whereat we went back to the past from the bottom dead center of the plunger 2 by the pump delay angle PUMRE that is a time period corresponding to the actuator operating time period is regarded as a lower limit value, and a point of time whereat the plunger 2 reaches the top dead center is regarded as an upper limit value, and limiter processing is performed with the above-described two points of time as the lower limit value and the upper limit value respectively. Outside this range, the on-signal is caused not to be outputted.

As described above, the embodiments of the present invention exhibit the following functions on the basis of the above-described structure.

The control unit 515 according to the present embodiment is a control device of a high-pressure fuel pump of a direct injection internal combustion engine 507 having a fuel injection valve 54 provided on a cylinder 507*b* and a high-pressure fuel pump 1 for pumping fuel to the fuel injection valve 54, characterized in that the high-pressure fuel pump 1 comprises: a plunger 2 for pressurizing the fuel in the high-pressure fuel pump 1; a solenoid 200, the phase of which is controlled in order to realize the variable discharge or pressure of the high-pressure fuel pump 1 and an inlet valve 5 for closing an inlet passage 10 of fuel through an ON-signal from the solenoid 200, and that the control device has pump control signal calculating means 1502; since it limits ON-signal end timing of the solenoid in order that there remains no attraction force of the solenoid 200 in the next discharge stroke of the high-pressure fuel pump 1, the pump control signal calculating means 1502 is capable of preventing the high-pressure fuel pump 1 from discharging an amount of fuel unintended, preventing the solenoid output signal from being outputted in a phase incapable of pumping the fuel, controlling the fuel pressure optimally and swiftly, and stabilizing the combustion and improving the emission gas performance.

Next, with reference to FIGS. 25 and 26, the description will be made of quality/characteristics of the control device of a high-pressure pump of an internal combustion engine according to the present embodiment.

Figure 25:
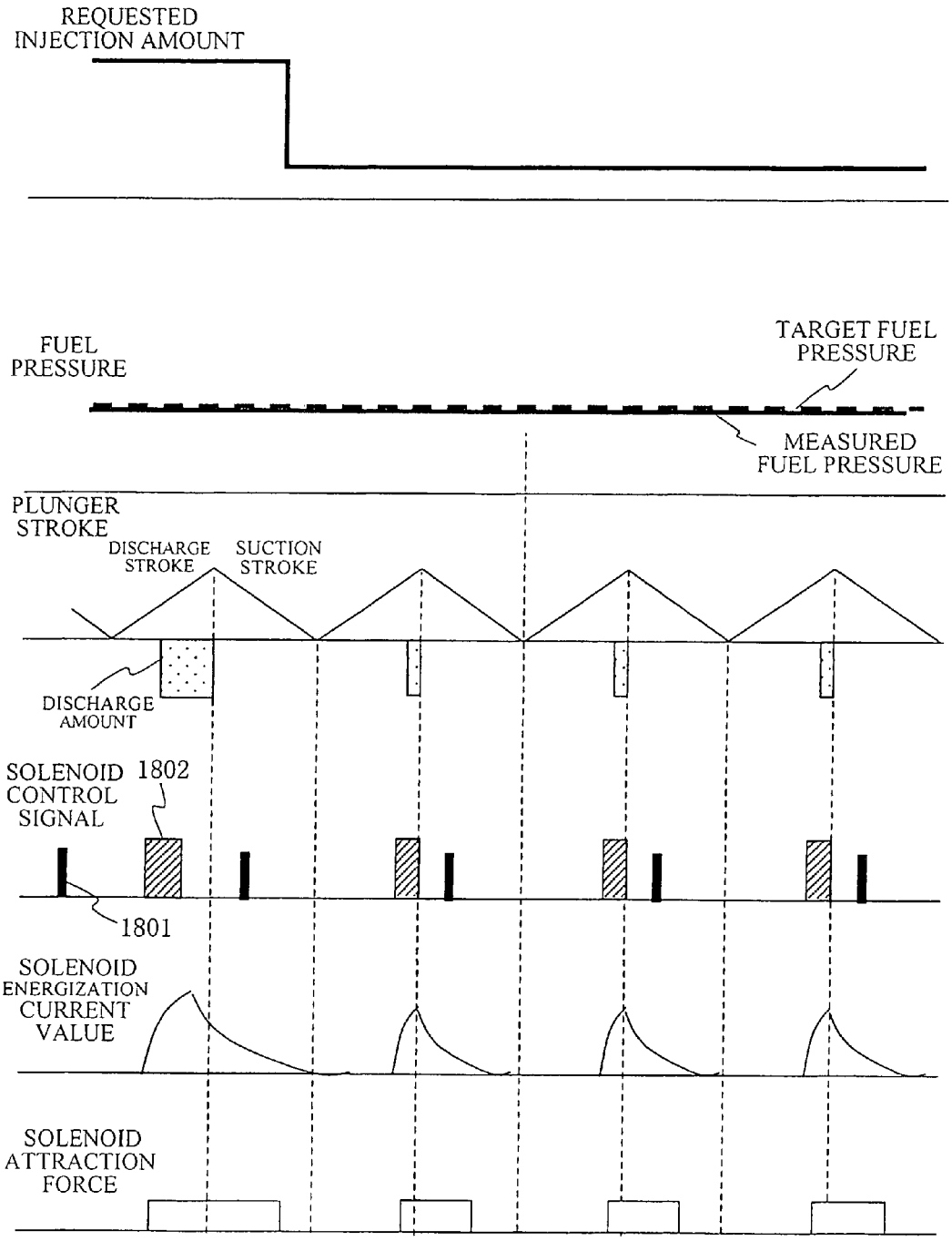
FIG. 25 is a basic operation timing chart during control of fuel pressure of the control device of a high-pressure fuel pump according to each embodiment of the present invention.

FIG. 25 is an operation timing chart by the control device of the high-pressure fuel pump when energization signal end timing according to the present embodiment has been controlled.

Figure 27:
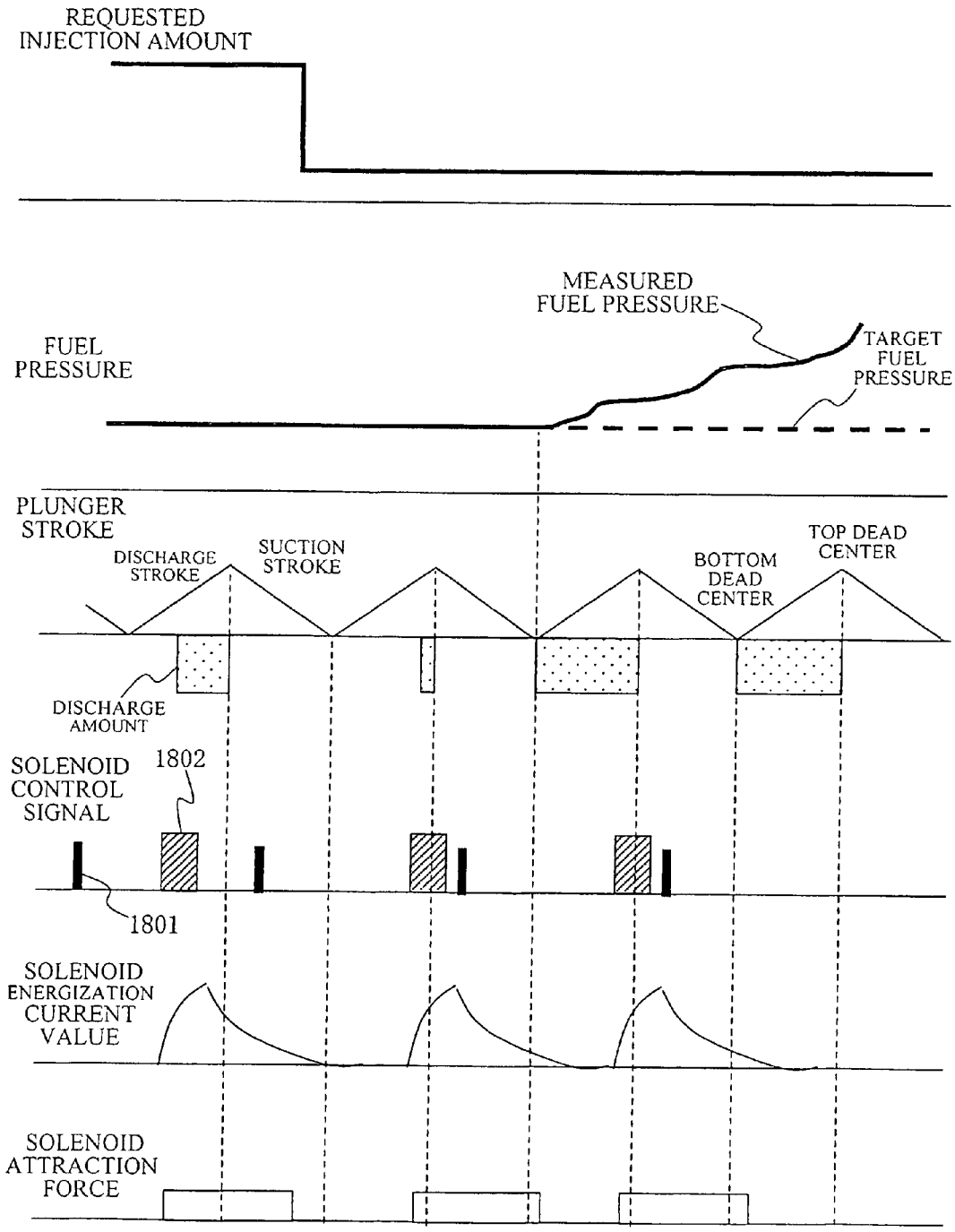
FIG. 27 is a basic operation timing chart during control of fuel pressure of the conventional control device of a high-pressure fuel pump.

As easily understood by comparing with the conventional operation timing chart of the control device of the high-pressure fuel pump of FIG. 27, by controlling the energization signal (solenoid control signal) end timing, the control device of the high-pressure fuel pump according to the present embodiment becomes possible to reliably perform small amount fuel injection, and as a result, is capable of reliably controlling to target fuel pressure, preventing an accidental fire and adhesion of fuel within the cylinder, and contributing to reduction of unnecessary ingredients of emission gas.

Figure 26:
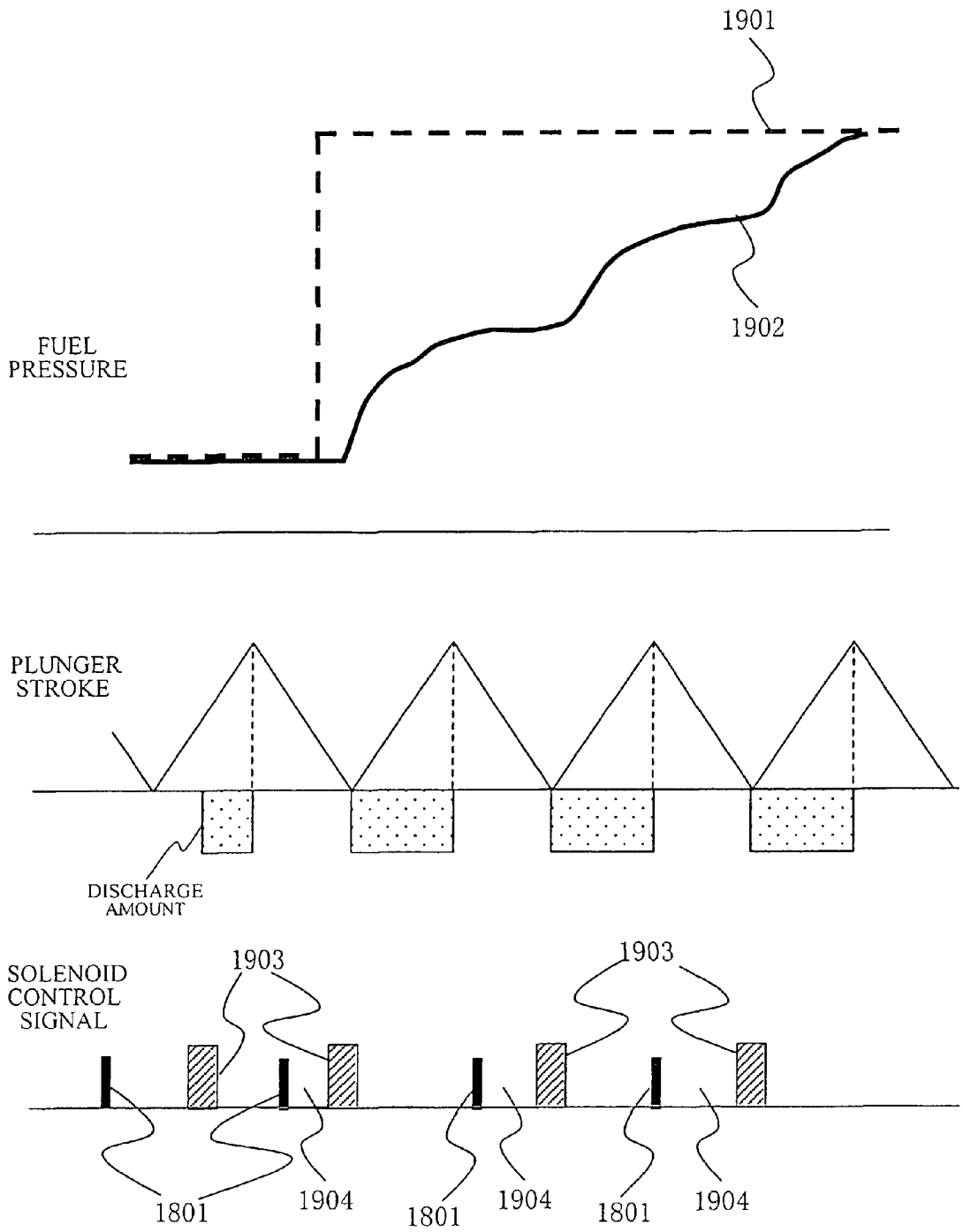
FIG. 26 is an operation timing chart when output timing during control of fuel pressure is limited in the control device of a high-pressure fuel pump according to each embodiment of the present invention.

FIG. 26 is an operation timing chart due to the control device of the high-pressure fuel pump when the output timing is limited according to the present embodiment.

As shown in FIG. 26, it can be seen that a REF signal 1801 generated from the cam angle signal and the crank angle signal is outputted, and after a restricted interval 1904 by the phase limiting means 1101 with the REF signal 1801 as a reference, the solenoid control signal 1903 is outputted by angle or time control within a phase range capable of pumping the fuel.

Figure 28:
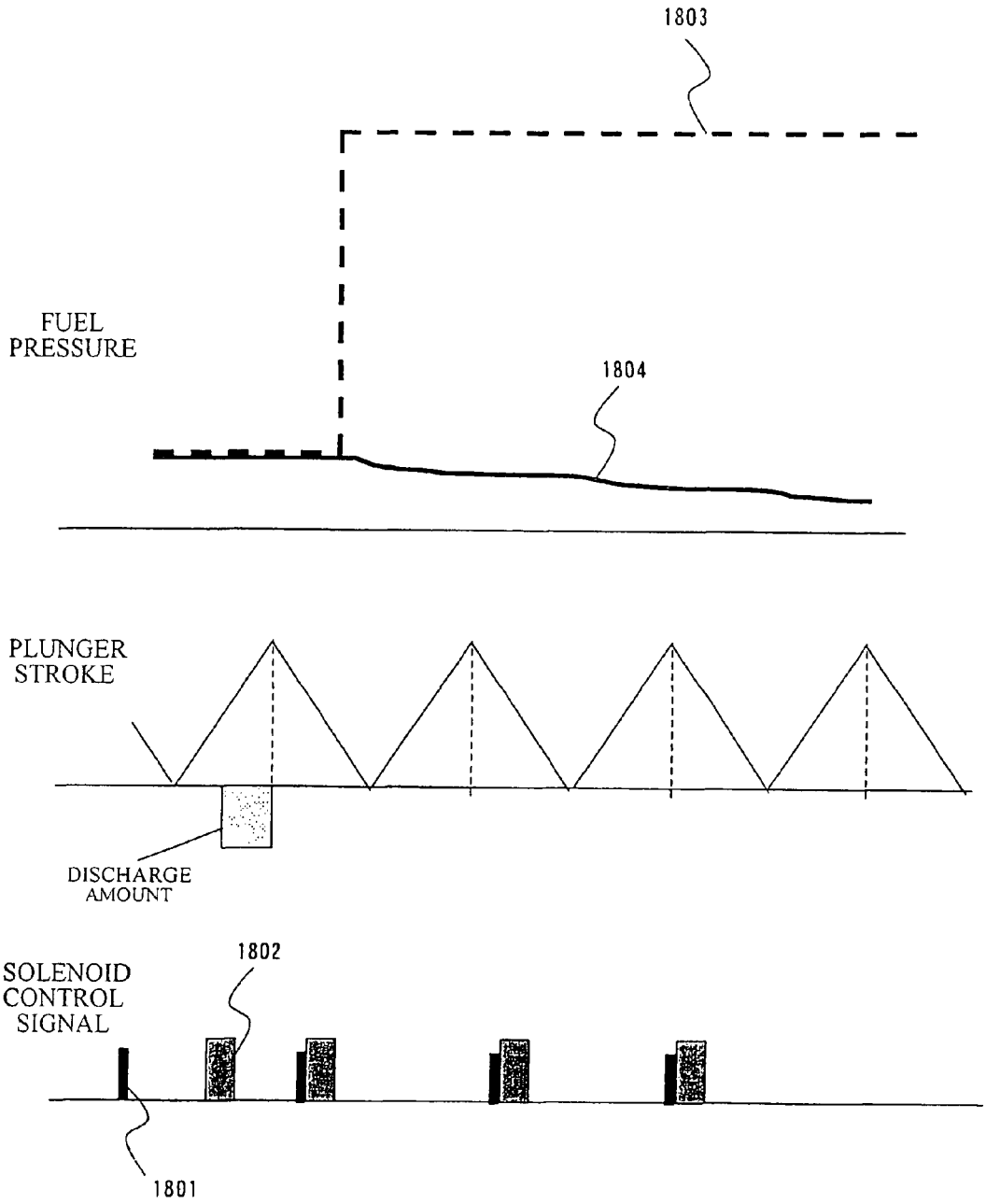
FIG. 28 is an operation timing chart during control of fuel pressure in the conventional control device of a high-pressure fuel pump.

For this reason, even if the target fuel pressure 1901 is raised high, it is possible to secure fuel discharge at the bottom dead center of the plunger 2; therefore, the measured fuel pressure 1902, that is actual fuel pressure, follows swiftly the target fuel pressure 1901 to promote a rise in fuel pressure as compared with the conventional example shown in FIG. 28; atomization of spray particle size from each injector 54 can be promoted; it is also possible to achieve reduction in discharge of HC. Also, at the time of starting the internal combustion engine, the starting time period can be shortened.

Further, since it stabilizes the high-pressure fuel supply system on the basis of the fixed value α due to the pressure difference fixed value calculating means 1501, the pump control signal calculating means 1502 according to the present embodiment is capable of further improving reliability of the direct injection internal combustion engine 507.

Although the detailed description has been made of the embodiments of the present invention above, the present invention is not limited to those embodiments, but various alterations can be made in design without departing from the spirit of the present invention described in the CLAIMS.

For example, in the above-described embodiment, the high-pressure fuel pump 1 has been arranged on the camshaft of the exhaust valve 526, but it may be possible to arrange on the camshaft of the inlet valve 514 or to synchronize to the crankshaft 507*d* of the cylinder 507*b*.

Also, as a method for limiting energization signal end timing, there may be used a method for terminating an energization signal by an electronic circuit when the plunger rises in the vicinity of the top dead center with the plunger position of the high-pressure fuel pump as switch input.

Further, in the above-described embodiment, by operating the inlet valve of the high-pressure fuel pump by the solenoid (actuator), the pressure within the pressure chamber of the pump has been adjusted, but as regards pressure adjustment within the pressure chamber, not only the above-described inlet valve, but also another fuel valve which is arranged between the pressure chamber of the pump and the outside of the pump and communicates and passes the fuel can execute the present invention. The fuel valve may, in addition to the inlet valve, be a relief valve which releases the fuel within the pressure chamber of the pump. In the case of the relief valve, it will become specifically different from the inlet valve in a way of the operation in the solenoid (actuator), but will be the same in executing the invention described in the CLAIMS of the present application.

INDUSTRIAL APPLICABILITY

As understood from the above-described description, the control device of a high-pressure fuel pump of an internal combustion engine according to the present invention is capable of controlling the fuel pressure optimally and swiftly, and preventing the emission gas from being worsened because it limits the output range of the solenoid control signal to be within a predetermined phase range and the end timing to be within the predetermined phase range.

The invention claimed is:

1. A method of controlling a high-pressure fuel pump of an internal combustion engine having a pressure chamber into which fuel flows through an inlet valve and is pumped under high-pressure and then discharged through a discharge valve, comprising the steps of:

sending a drive signal having a start phase and an end phase to an actuator for operating said inlet fuel valve to cut off fuel flow to said pressure chamber, calculating the end phase of the drive signal with respect to a first predetermined phase, and setting the end phase as the calculated end phase when the calculated end phase is on an advanced side of the first predetermined phase, and setting the first predetermined phase as the end phase when the calculated end phase is on a delayed side of the first predetermined phase.

2. The method according to claim 1, wherein said first predetermined phase is set to be prior to top dead center of a plunger of said pump.

3. The method according to claim 1, wherein said calculating the end phase of the drive signal calculates an end phase of the drive signal using at least one of a number of revolutions of the engine, a fuel quantity injected from said fuel injection valve, battery voltage and coil resistance.

4. The method according to claim 1, wherein said calculating the end phase of the drive signal is performed with an electronic circuit.

5. The method according to claim 1, further including changing at least one of a fuel quantity injected from said fuel injection valve, fuel injection timing and ignition timing is changed when a calculated end phase is on the delayed side of the first predetermined phase.

6. The method according to claim 1, further including calculating a start phase of a drive signal to the actuator with respect to a second predetermined phase, including setting the calculated start phase as the start phase when the calculated start phase is on a delayed side of the second predetermined phase and setting the second predetermined phase as the start phase when the calculated start phase is on the advanced side of the second predetermined phase.

7. The method according to claim 6, wherein said second predetermined phase is set at a point of time before bottom dead center of a plunger of the pump by a time period equal to the operation of the actuator or thereafter.

8. The method according to claim 6, wherein said calculating the start phase of the drive signal limits said start phase of the drive signal to the actuator to be on the advanced side before a top dead center of said plunger of the pump.

9. The method according to claim 6, wherein said calculating the start phase of the drive signal limits said start phase of a drive signal to an actuator to be at a point of time before bottom dead center of a plunger of the pump by a time period equal to the operation of said actuator or thereafter, and prior to the top dead center of said plunger.

10. The method according to claim 9, wherein said calculating the start phase of the drive signal includes operating a reference angle of said actuator on the basis of a basic angle of said actuator, target fuel pressure and actual fuel pressure, and correcting a working delay of the actuator.

11. The method according to claim 10, wherein said calculating the start phase of the drive signal operates on the basis of output signals from the operating of a reference angle of said actuator.

12. The method according to claim 10, wherein said calculating the start phase of the drive signal operates on the basis of output signals from the operating of a reference angle of said actuator and the correcting a working delay of said actuator.

13. The method according to claim 11, wherein said calculating the start phase of the drive signal and said calculating the end phase of the drive signal retrieves said first and second predetermined phases in response to an operating state of said internal combustion engine.

14. The method according to claim 10, further including calculating a feedback control quantity from a difference between actual fuel pressure and target fuel pressure, wherein said calculating the start phase of the drive signal and the end phase of the drive signal is calculated on the basis of said feedback control quantity.

15. The method according to claim 10, further including calculating a control quantity for causing an actual fuel pressure to reach said target fuel pressure, wherein the calculating of the start phase of the drive signal and the end phase of the drive signal is calculated on the basis of said control quantity.

16. The method according to claim 6, wherein said calculating the start phase of the drive signal and the end phase of the drive signal makes the start and end phases of the drive signal of the actuator vary according to a number of revolutions of internal engine and/or battery voltage.

17. The method according to claim 1, further including calculating a fuel pressure difference between an actual fuel pressure and a target fuel pressure, wherein said high-pressure fuel pump is prohibited from pumping up, when the pressure difference exceeds a predetermined value and continues longer than a predetermined period.

18. The method according to claim 1, further including calculating a fuel pressure difference between an actual fuel pressure and a target fuel pressure, wherein said high-pressure fuel pump is caused to discharge a whole amount of fuel of the pressure chamber when the pressure difference exceeds a predetermined value, and said actual fuel pressure is lower than said target fuel pressure.

19. The method according to claim 1, further including calculating a fuel pressure difference between an actual fuel pressure and a target fuel pressure, wherein said high-pressure fuel pump is prohibited from pumping-up, when the pressure difference exceeds a predetermined value, and said actual fuel pressure is higher than said target fuel pressure.

20. The method according to claim 19, further including retrieving said predetermined value or said predetermined time period in response to an operating state of the internal combustion engine.

* * * * *